United States Patent [19]

Fujikawa et al.

[11] Patent Number: 5,050,304

[45] Date of Patent: Sep. 24, 1991

[54] HAIR CLIPPER

[75] Inventors: Shoji Fujikawa, Ishibe; Masakatsu Araki, Hikone; Shinichiro Tsujimura, Nagahama, all of Japan

[73] Assignee: Matsushita Electric Works, Ltd., Japan

[21] Appl. No.: 446,124

[22] Filed: Dec. 5, 1989

[30] Foreign Application Priority Data

Dec. 15, 1988 [JP] Japan ..... 63-316884

[51] Int. Cl.[5] ..... B26B 19/04

[52] U.S. Cl. ..... 30/196; 30/200

[58] Field of Search ..... 30/195, 196, 197, 198, 30/199, 200, 201

[56] References Cited

U.S. PATENT DOCUMENTS

| | | | |
|---|---|---|---|
| 1,713,369 | 5/1929 | Borrmann | 30/201 |
| 3,387,367 | 6/1968 | Merzon | 30/201 |
| 4,614,036 | 9/1986 | Haraguchi | 30/200 |
| 4,825,546 | 5/1989 | Araki et al. | 30/201 |

FOREIGN PATENT DOCUMENTS

| | | | |
|---|---|---|---|
| 648078 | 7/1937 | Fed. Rep. of Germany | 30/196 |
| 3441060 | 6/1985 | Fed. Rep. of Germany . | |
| 0031351 | 3/1979 | Japan | 30/201 |

*Primary Examiner*—Frank T. Yost
*Assistant Examiner*—John M. Husar
*Attorney, Agent, or Firm*—Stevens, Davis, Miller & Mosher

[57] ABSTRACT

A hair clipper includes a cutter head and a hair entrapping member which is movable toward and away from a cutting edge of the cutter head. The cutter head comprises a stationary blade with a toothed edge defining a cutting edge of the cutter head and a movable blade with a like toothed edge. The movable blade is driven to reciprocate in shearing engagement between the toothed edges of the stationary and movable blades for shearing hairs therebetween. The hair entrapping member is preferably in the form of a comb which is movable between an open position and a closed position. In the open position the comb is spaced away from the cutting edge of the cutter head, thus permitting hairs to enter between the comb and the cutting edge. In the closed position, the comb is held close to the cutting edge to thereby seize the hairs therebetween for shearing the hairs. Thus, the hair shearing can be made by guiding the comb across the skin of a head while maintaining the cutting edge spaced from the skin, avoiding a direct contact of the cutting edge with the head skin and preventing an accidental injury of the skin by the cutting head during the hair shearing operation.

15 Claims, 21 Drawing Sheets

33
30
31
15
11
10
19
16
43
62
42
47
41
44
40
45
37
92
90
46
64
67
60
66
91
67
22
61
65
63
64
51
23
20
18
16
54
12
100
52
53
29
75
72
100
103
101
79
27
80
78
77
75
72

HAIR CLIPPER

BACKGROUND OF THE INVENTION

1. Field of the Invention

The present invention is directed to a hair clipper, and more particularly to a home use hair clipper having a cutter head and a hair entrapping member which is movable toward and away from a cutting edge of the cutter head.

2. Description of the Prior Art

Home hair shearing has been generally done by the use of a scissors. With the scissors, it is rather difficult for an unskilled person to perform hair shearing since it requires to manipulate the scissors in one hand and at the same time to hold hairs between the fingers of the other hand. Particularly, when manipulating the scissors, the blade edges of the scissors will engage the hairs at an inclined angle and be likely to push the hairs out of position along the blade edges as the blades are closed, failing to provide a straight cut. Thus, a straight cut with the use of the scissors requires a considerable skill and is found not to be practical in home. On the other hand, powered hair clippers have been utilized for many years in homes which are easy to manipulate and to effect a straight cut. The prior hair clipper, as typically shown in U.S. Pat. No. 4,825,546, is provided with a cutting head having a toothed stationary blade and a toothed movable blade. The movable blade is driven to reciprocate in hair shearing engagement between the toothed edges of the stationary and movable blades. Although the prior hair clipper may have a comb projecting past the cutting edge of the cutter head, it is manipulated to move in advance of the cutting edge which are held in contact or in close relation with the skin. Therefore, the prior art hair clipper is still required to be carefully manipulated so as not to injure the skin by the cutting edge. This is particularly important when shearing the hair of a baby. As known from the above, the prior hair clipper is found to be still unsatisfactory for easy and safe hair cutting.

SUMMARY OF THE INVENTION

The above problem has been eliminated by the present invention which provides a unique hair clipper which can be safely and easily manipulated by an unskilled person and is particularly suitable for home use. The hair clipper in accordance with the present invention comprises a cutter head and a hair entrapping member which is adapted to be in slidable contact with the skin of a head. The cutter head includes a stationary blade with a toothed edge which defines a cutting edge of the cutter head and a movable blade with a like toothed edge. The movable blade is driven to reciprocate in hair shearing engagement between the toothed edges of the stationary and movable blades for shearing hair therebetween. The hair entrapping member is made movable between an open position and a closed position. In the open position the hair entrapping member is spaced away from the cutting edge to allow hair to enter between the member and the cutting edge. In the closed position, the comb is held close to the cutting edge so as to seize the hair therebetween for shearing the hair. Thus, the hair shearing can be made by guiding the hair entrapping member across the skin of the head to collect the hair between the member and the cutting edge and subsequently to shear the thus collected hair by the cutting edge. In this manner, hair shearing can be made by repeating to move the hair entrapping member from the open position to the closed position while guiding only the hair entrapping member in direct or close contact with the skin and maintaining the cutting edge spaced away from the skin, eliminating the possibility of injuring the skin by the cutting edge during the hair shearing operation. Further, since the shearing is effected to the bulk of the hair held between the hair entrapping member and the cutting edge, it is easy to provide a straight cut with the clipper of the present invention.

Accordingly, it is a primary object of the present invention to provide a hair clipper which is capable of assuring easy and safe hair shearing, yet assuring an exact straight cut.

In a preferred embodiment, the cutter head is provided at a forward end of an elongated housing which incorporates a motor for driving the movable blade to reciprocate. The hair entrapping member is provided also at a forward end of an elongated base which is pivotally connected to the housing at the respective rear ends to form a clipper assembly resembling a conventional stapler. That is, the base pivots about a pivot axis relative to the housing to move the hair entrapping member toward and away from the cutting edge, i.e., in the closed and open positions in a manner as manipulating a stapler. The base is spring biased in the direction of moving the hair entrapping member into the open position. Thus, the hair cutting can be performed by closing the housing to the base against the bias in much the same way as the stapler. The hair entrapping member is preferably in the form of a comb having a number of comb teeth arranged in parallel with the cutting edge for smoothing the hairs into between the comb and the cutting edge.

It is therefore another object of the present invention to provide a hair clipper which can be easily manipulated in a like manner as utilizing a conventional stapler and is capable of smoothly guiding the hair past the cutting edge for effective hair shearing.

The movable blade is concealed behind the stationary blade and has its toothed edge offset or retarded from the corresponding toothed edge of the stationary blade. The comb is located at the front edge of the base and is arranged to be positioned forwardly of the toothed edge of the stationary blade in the closed position. The comb is formed at its trailing edge with a portion projecting toward the cutting edge. The projecting portion defines immediately therebehind a recess into which the toothed edge of the stationary blade extends when the comb is brought into the closed position such that the projecting portion of the comb overlaps the toothed edge of the stationary cutter and also the toothed edge of the movable blade. That is, the toothed edge of the stationary blade can hardly miss the hairs which have been guided past the comb, thereby assuring to successfully shear the hairs to a desired length.

It is therefore a further object of the present invention to provide a hair clipper which is capable of assuring a smooth and even hair cut.

Included in the housing is a power switch which is associated with the pivotal movement of the base relative to the housing such that it energizes the motor in response to the comb brought into the closed position and deenergize the motor in response to the comb brought into the open position. With this result, the movable blade is driven to reciprocate only when the comb is moved into the closed position and is rendered inoperative when the comb is in the open position. In other words, the movable blade can be driven to reciprocate only in the cutting condition and can be kept otherwise stationary so as to well prevent accidental injury of the skin by the reciprocating movable blade even when the movable blade accidentally comes into contact with the skin, which is therefore a still further object of the present invention.

The base is of a generally U-shaped configuration having a bottom and a pair of opposed side walls extending from the lateral sides of the bottom wall to define therebetween room for receiving a bottom portion of the housing when the base is closed to the housing. The room is divided by a transverse partition into longitudinally spaced front and rear portions. The front portion has the bottom wall terminating at the comb and defines therein a dust chamber for collecting the clipped hairs.

It is therefore a further object of the present invention to provide a hair clipper in which the clipped hairs can be collected into the dust chamber formed in the base adjacent to the comb.

The base is also configured to be pivotable to a further extent past the open position into an extended position where the cutting edge is spaced from the comb by a considerable extent so that the cutting head can be alone manipulated in direct contact with the skin for effecting hair trimming. To this end, the power switch has another mode in which it energizes the motor independently of the pivotal movement of the base relative to the housing.

It is therefore a further object of the present invention to provide a hair clipper which is capable of effecting a conventional hair trimming operation in addition to the above-mentioned safe hair shearing with the use of the movable comb.

These and still other objects and advantages of the present invention will become more apparent from the following detailed description of the preferred embodiments when taken in conjunction with the accompanying drawings.

DETAILED DESCRIPTION OF THE PREFERRED EMBODIMENTS

First Embodiment <FIGS. 1 to 15>

Figure 1:
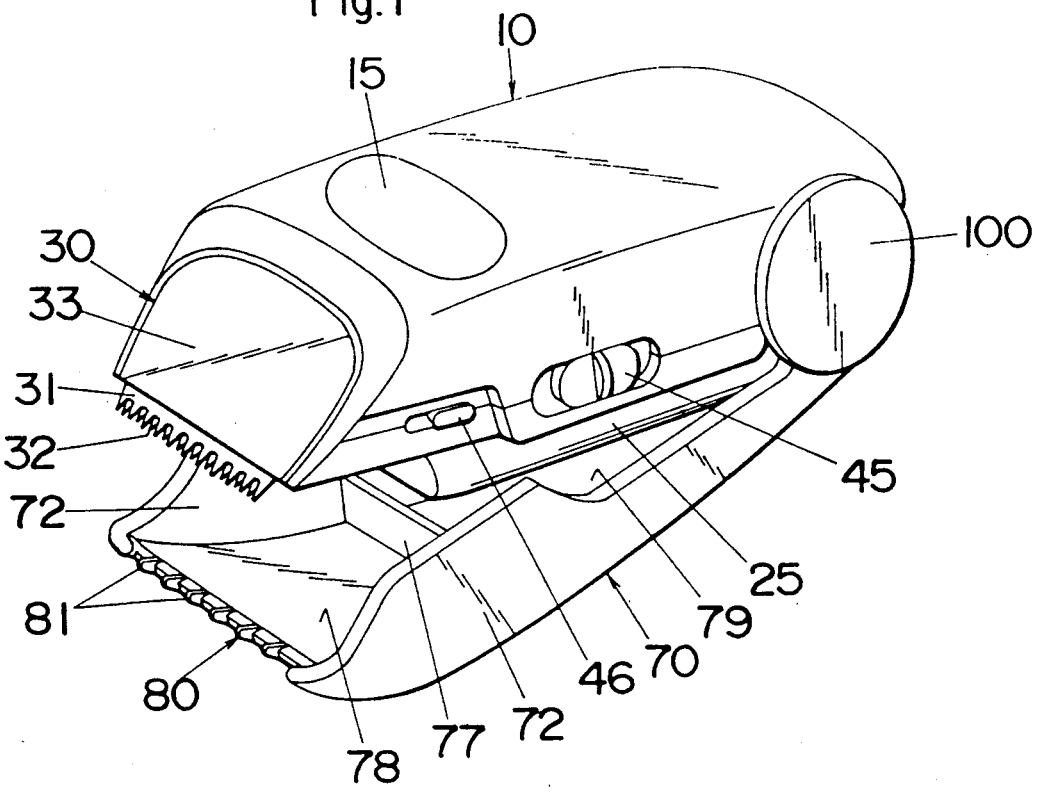
FIGS. 1 and 2 are perspective views of a hair clipper shown respectively in open and closed positions in accordance with a first embodiment of the present invention.
Figure 3:
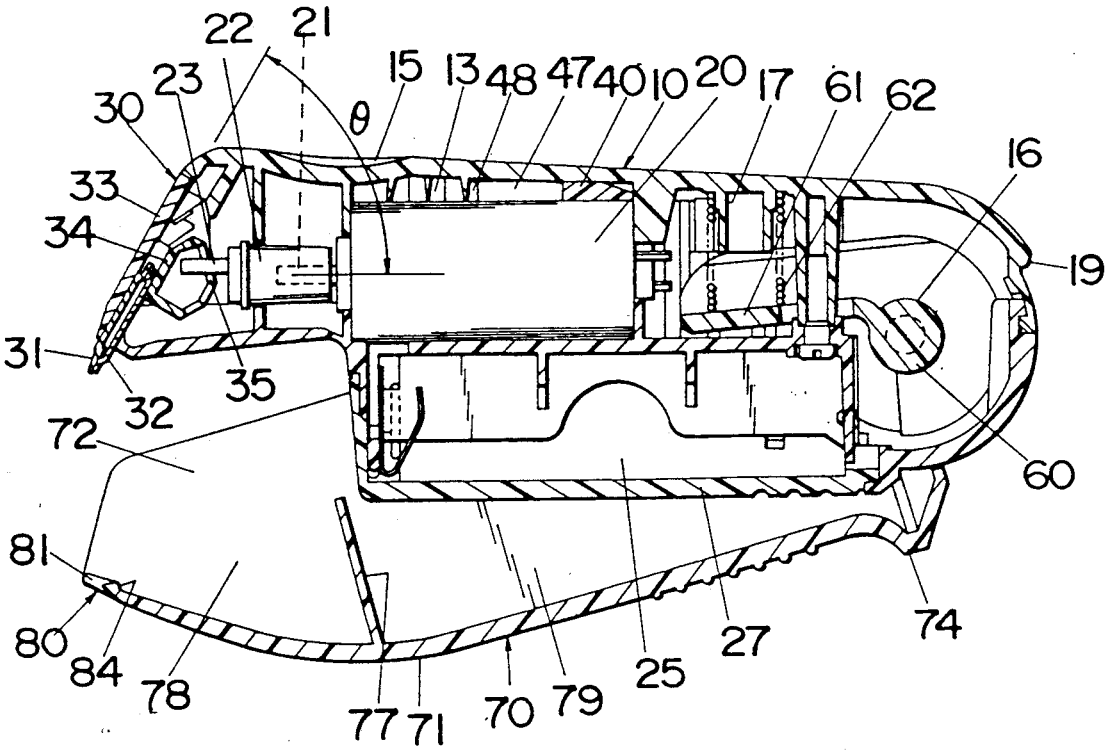
FIGS. 3 and 4 are sectional views of the hair clipper respectively in its open and closed positions.
Figure 4:
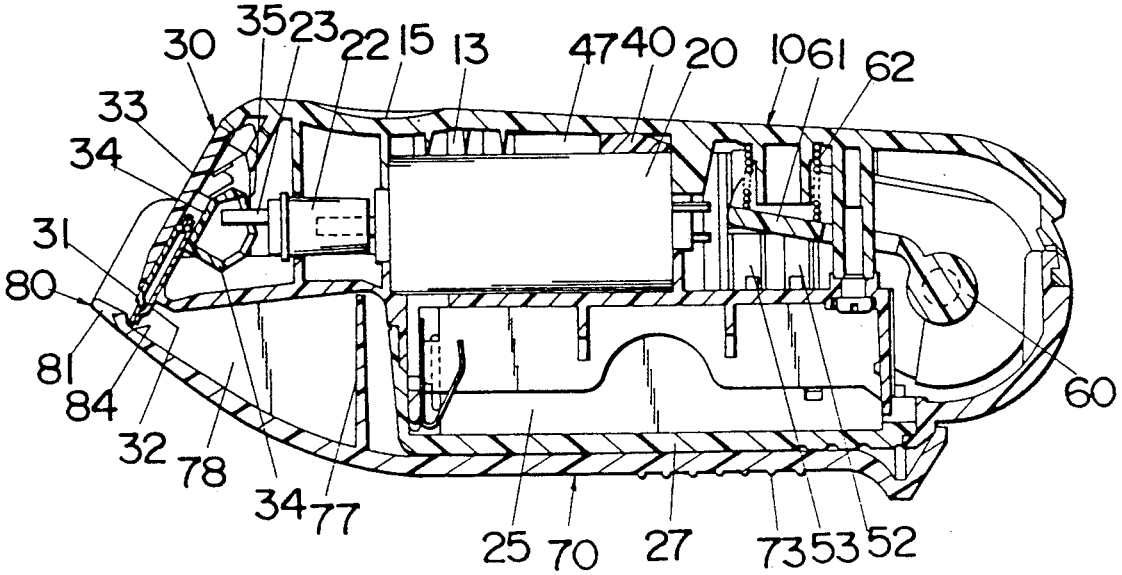
Figure 5:
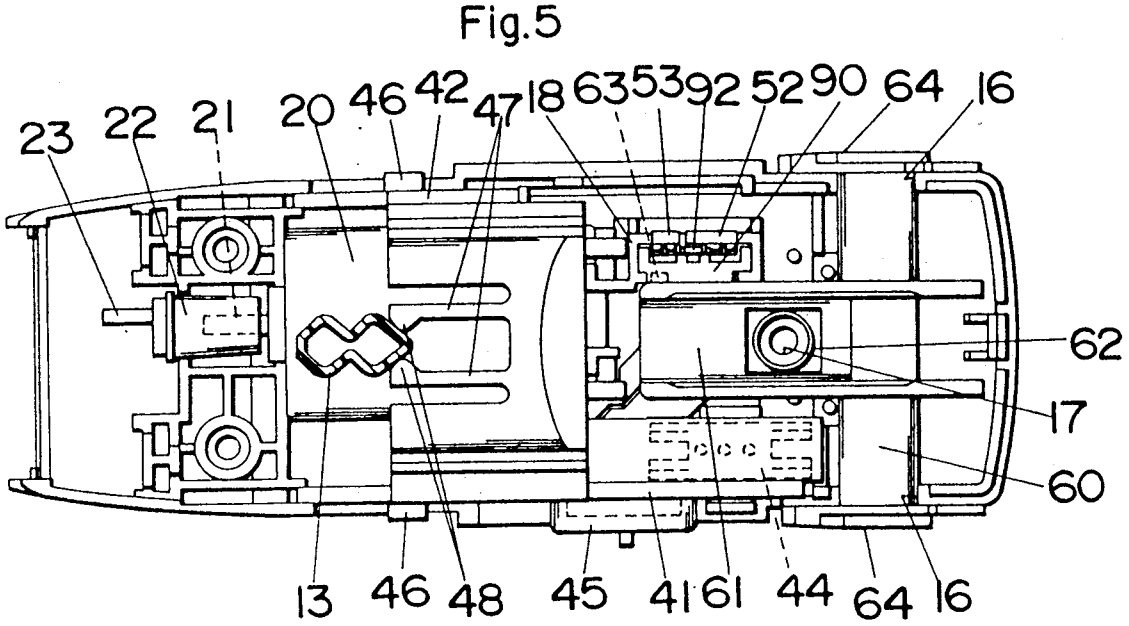
FIG. 5 is a plan view of the hair clipper with a top portion of a housing and a base removed.

Referring now to FIG. 1, there is shown a hand-held clipper in accordance with a first embodiment of the present invention. The hair clipper comprises an elongated housing 10 and an elongated base 70 which are pivotally connected at their rear ends to be movable between an open position of FIG. 1 and a closed position of FIG. 2, in a manner like a conventional stapler. As seen in the figures, the housing 10 has its longitudinal axis crossed with a longitudinal axis of the base 70 at an angle of about 15° in the open position and has the former axis generally in parallel relation with the latter axis in the closed position. The housing 10 is provided at its front end with a cutter head 30 which comprises a stationary blade 31 with a toothed edge and a movable blade 32 with a like toothed edge. As shown in FIGS. 3 and 4, the stationary blade 31 is supported on an interior surface of a head plate 33 fitted in the front end of the housing 10. The movable blade 32 is supported at its one end by a carrier 34 which is held slidable on the interior surface of the head plate 33 such that the toothed edge of the movable blade 32 is in hair shearing engagement with the corresponding toothed edge of the stationary blade 31 with the leading edge of the movable blade 31 offset upwardly or retarded from the forwardly adjacent leading edge of the stationary cutter by a slight extent. The stationary blade 31 and the movable blade 32 define therebetween a cutting plane which is inclined by an angle Θ of 50° to 90° with respect to a longitudinal axis of the housing 10. The cutter head 30 thus formed is held in position by a pair of clips 37 each of which, as shown in FIG. 6, have its ends hooked to the head plate 33 and the interior of the housing 10.

Disposed in the middle of the housing 10 is an electric motor 20 which has an output shaft 21 coupled to a joint 22 with an eccentric shaft 23. The eccentric shaft 23 engages into a cam socket 35 formed on the carrier 34 in order to translate the rotational movement of the output shaft 21 into a reciprocating movement of the movable blade 32 relative to the stationary blade 31. A battery casing 25 is formed below the motor 20 to extend longitudinally over the middle and rear portions Of the housing 10 for receiving therein a couple of dry batteries (not shown) energizing the motor 20. The battery casing 25 is fitted with a detachable lid 27 which is slidable along the casing 25 to close the same.

Figure 6:
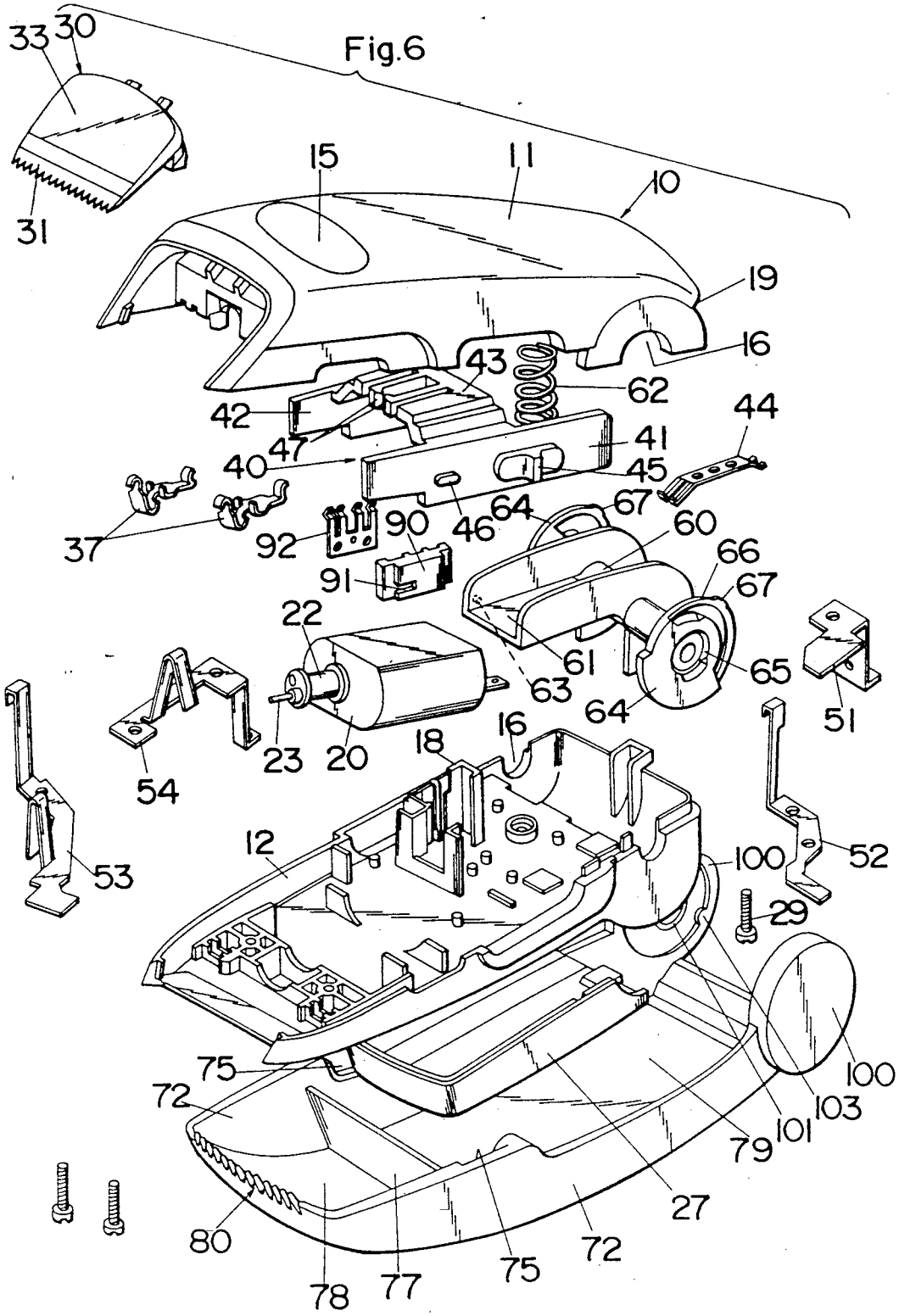
FIG. 6 is an exploded perspective view of the hair clipper.

As best shown in FIG. 6, the housing 10 comprises upper and lower halves 11 and 12 between which a slider 40 is received together with the motor 20. The slider 40 has a pair of opposed side bars 41 and 42 connected by a center plate 43 which is slidably held between the motor 20 and the inner surface of the upper housing 11. One of the side bar 41 is provided at its rear end with a contactor 44 which cooperates with contact leads 51 to 53 to form a main power switch $SW_1$ for connecting and disconnecting the motor 20 to and from the batteries. Also formed on the same side bar 41 is a switch handle 45 which projects on the side face of the housing 10. The center plate 43 includes a pair of resilient arms 47 each having a latch projection 48 at its free end. The latch projections 48 are engageable with a catch 13 which, as shown by a dotted line in FIG. 5, projects on the interior of the upper half 11 of the housing 10 in the form of a figure eight to define on either exterior side thereof three longitudinally spaced detent, i.e., those at the ends and the middle of the figure eight. During the slide movement of the slider 40, the resilient arms 47 flex outwardly in such a manner that the latch projection 48 can ride over the curved periphery of the catch 13 and is clicked into one of the three detent. Whereby the slider 40 is movable clickwise between three switching positions, i.e., OFF position, a dependent ON position, and an independent ON position, the detail of which will be discussed later.

Figure 2:
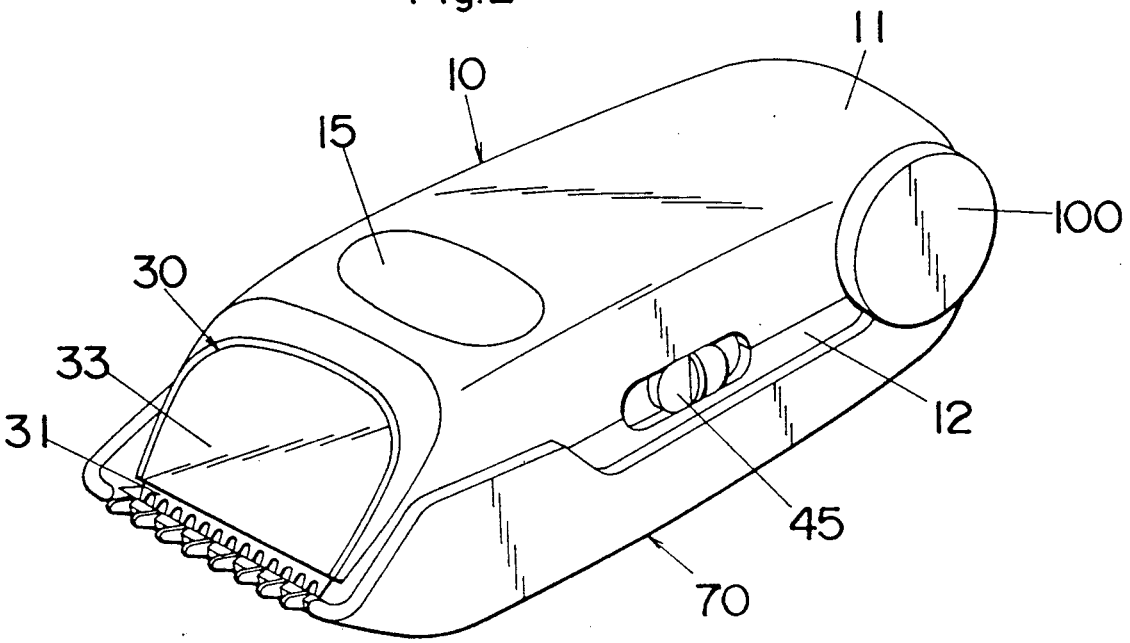
Figure 7:
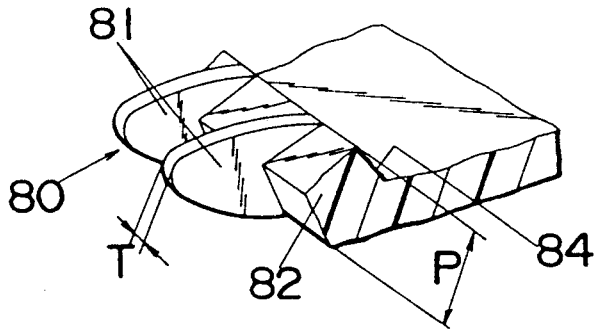
FIG. 7 is a partial perspective view of a comb formed in the front end of the base.
Figure 10A:
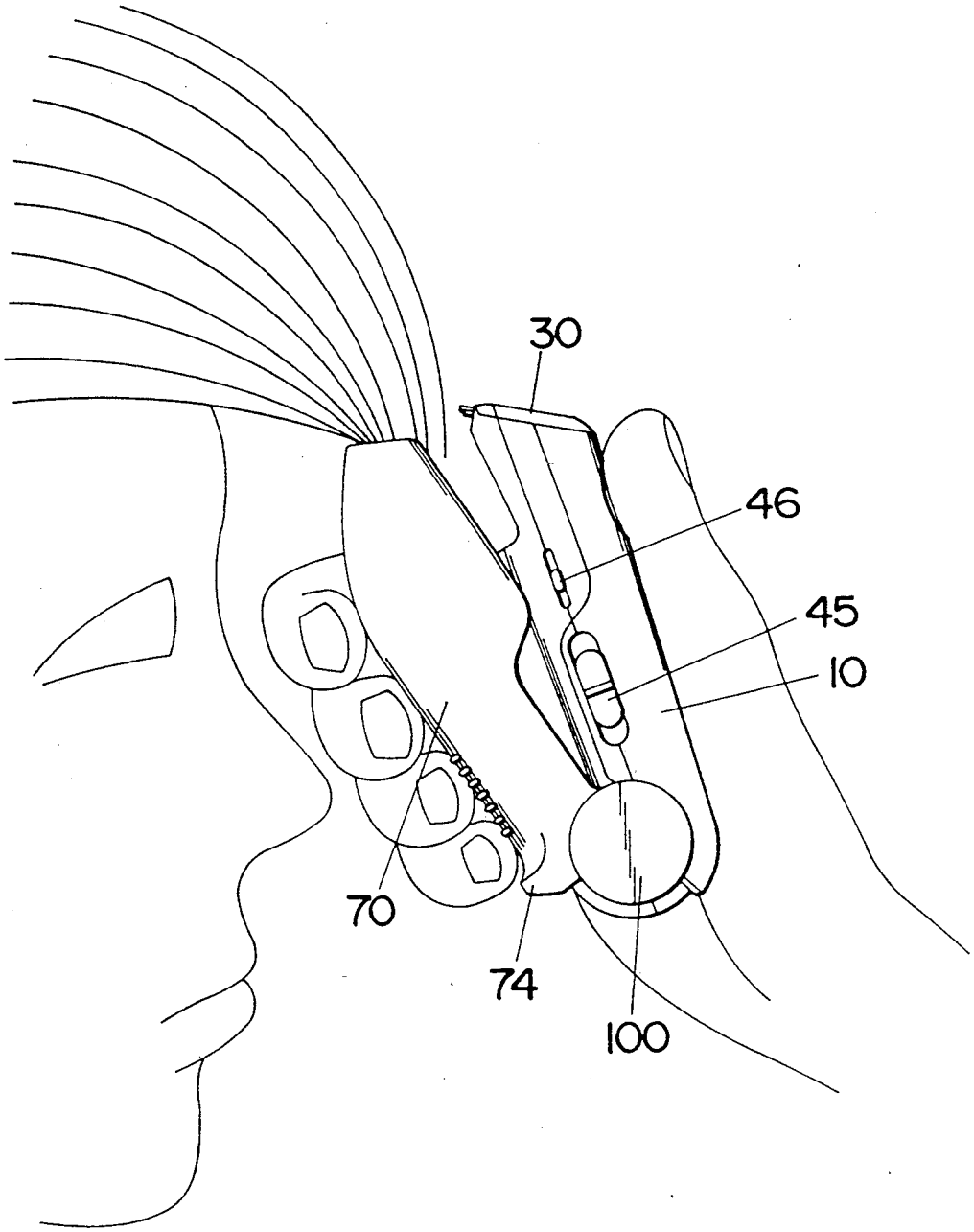
FIGS. 10A to 10C are respectively illustrations in different views of the hair clipper in its open condition.
Figure 10B:
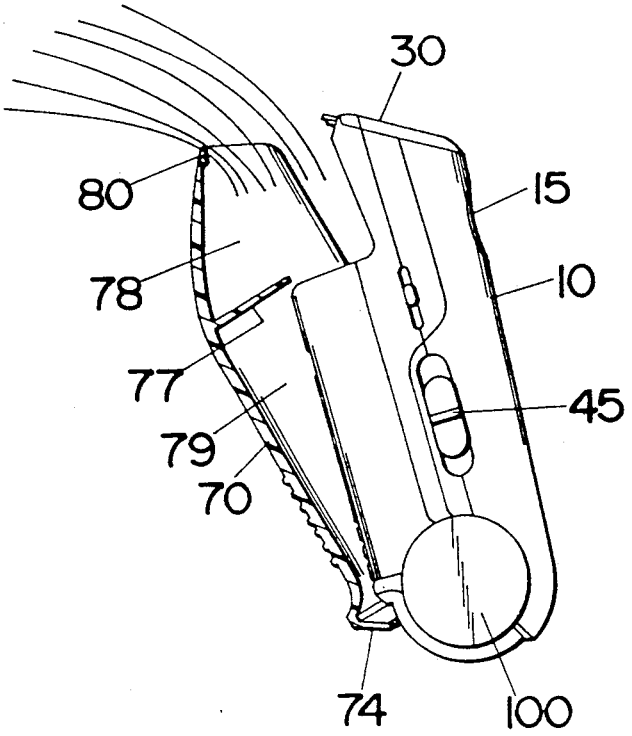
Figure 10C:
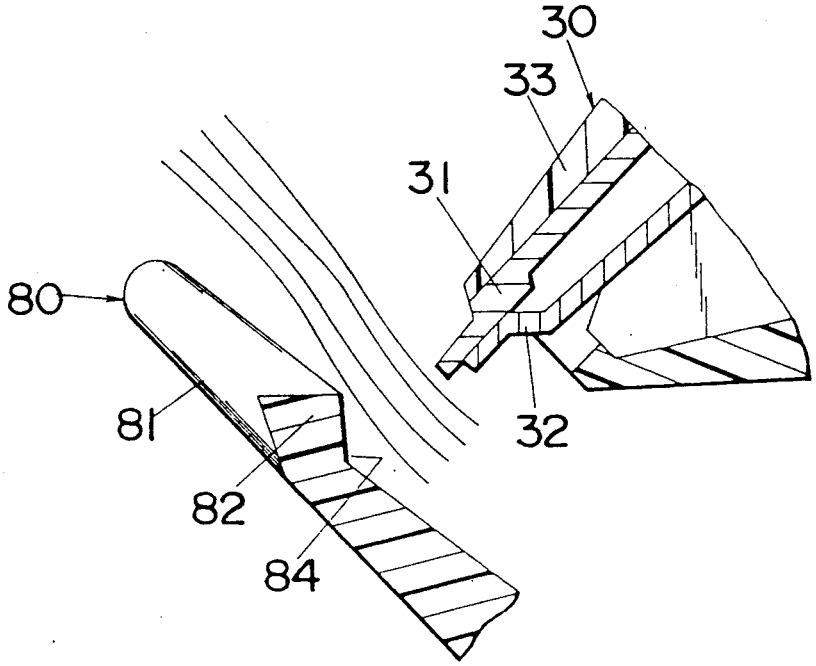

The base 70 is of a generally U-shaped configuration having a bottom wall 71 and a pair of opposed side walls 72 extending upwardly from the lateral sides of the bottom wall 71 to define therebetween a space for receiving the bottom portion of the housing 10 in the closed position of FIG. 2. Formed at the forward edge of the bottom wall 71 is a comb 80 with a number of comb teeth 81 arranged along the forward edge for smoothing hairs prior to shearing the hairs by the cutter head 30. As shown in FIG. 7, the comb 80 includes a tapered projection 82 which has an angled edge at its front and from which the comb teeth 81 project in the general plane of the front inclined portion of the bottom wall 71. As seen in the figure, each of the comb teeth 81 is in the form of a somewhat rounded flat fin having a thickness T greater than a thickness P of the projection 82. The projection 82 defines therebehind a recess 84 into which the cutting edge of the cutter head 30 project when the base 70 is pivoted into the closed position of FIG. 4. It is this closed position that the shearing is made to the hairs held between the comb 80 and the cutting edge as being smoothed by the comb 80. That is, as shown in FIGS. 10A to 10C, the hand clipper is firstly manipulated in its open position so as to smooth and guide the hairs between the comb 80 and the cutter head 30 and is then closed to the position of the position of FIGS. 11A to effect the hair shearing. In this manner, the hairs can be easily cut to straight without exposing the cutting edge in the vicinity of the skin, thereby assuring a safe hair shearing without the fear of accidentally injuring the skin by the cutting head. It should be noted at this time that, as shown in FIG. 3, the housing 10 in the open position has the battery casing 25 projected into the base 70 so as not leave therebetween any substantial gap, therefore eliminating the possibility of pinching the finger of the user between the housing 10 and the base 70 during the repeated operations of closing and opening the clipper. Further, the above inclined surface of the front portion of the bottom wall 71 is somewhat rounded to be readily guided across the skin particularly around the neck.

Figure 11A:
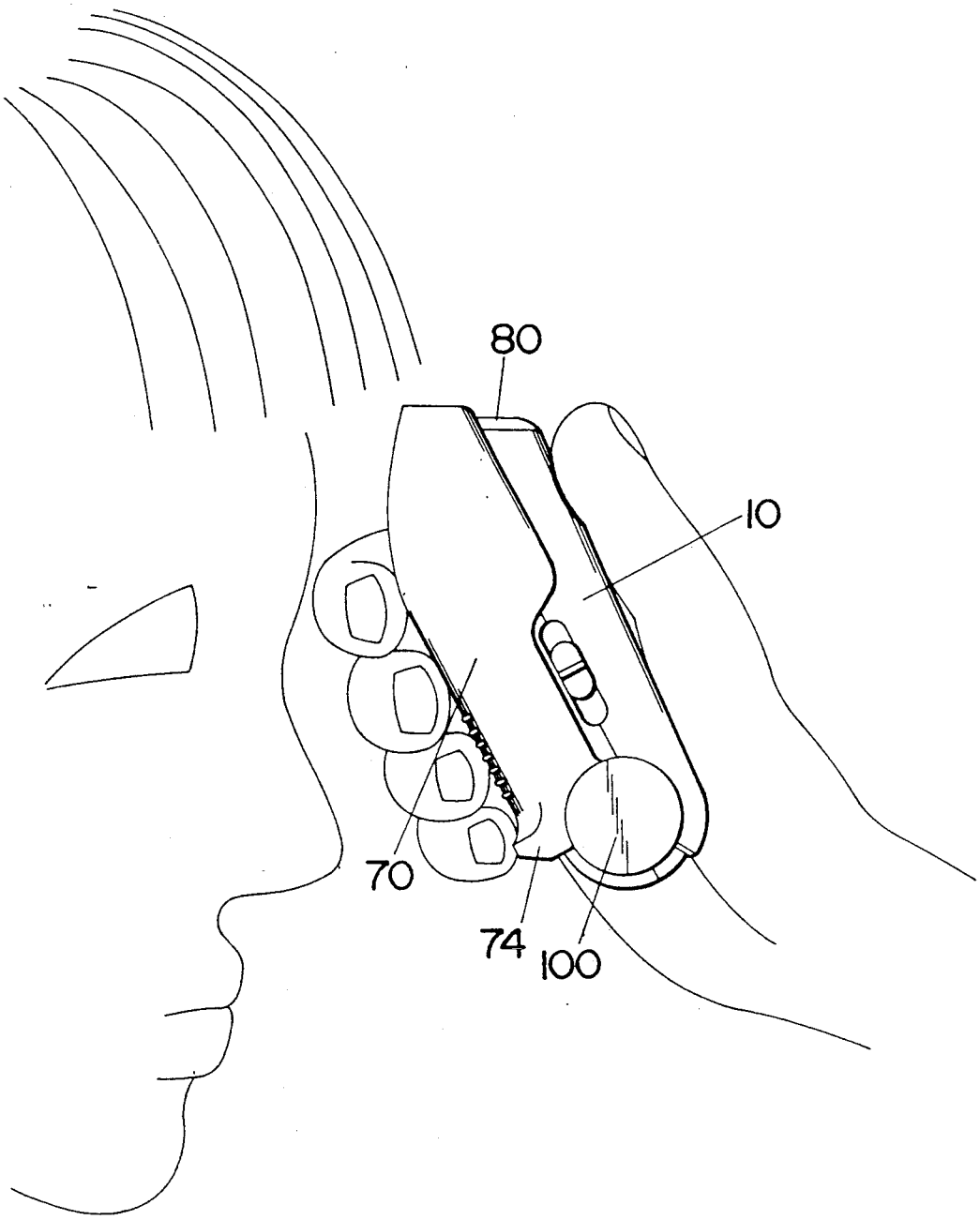
FIGS. 11A to 11C are respectively illustrations in different views of the hair clipper in its closed condition.
Figure 11B:
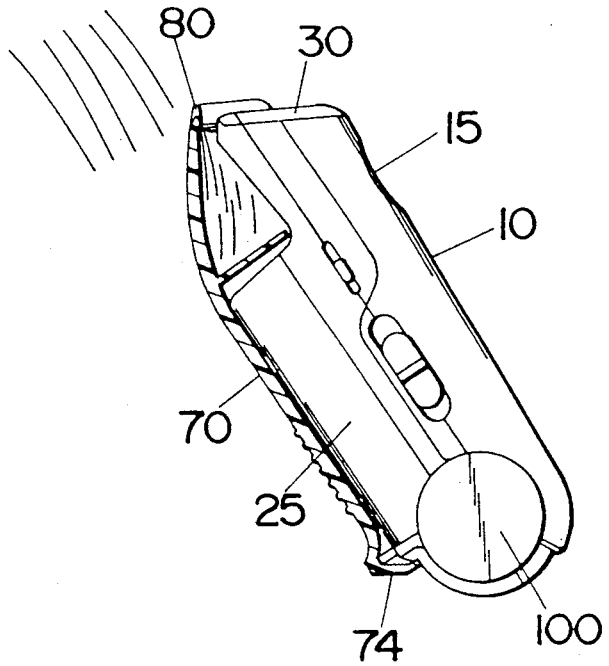
Figure 11C:
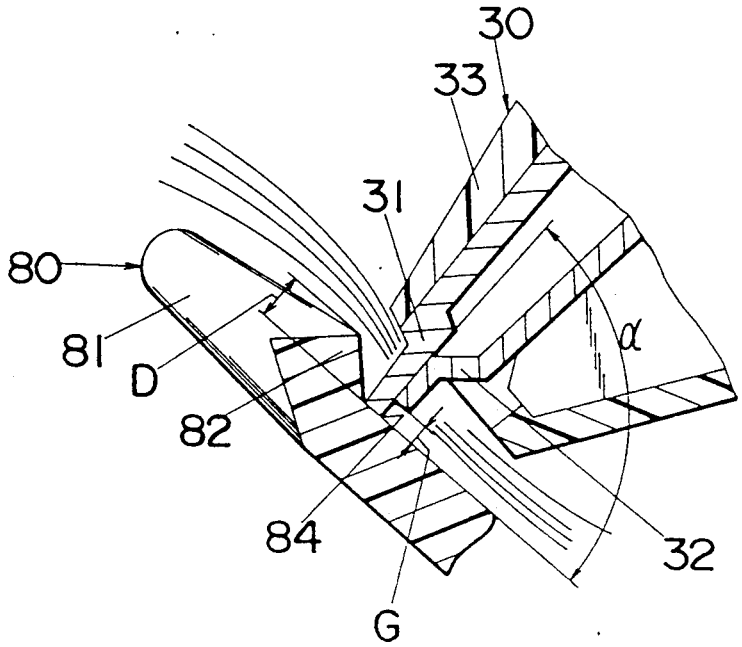

The recess 84 has a depth D which, as shown in FIG. 11C, is greater than a gap distance G between the leading edges of the stationary and movable blades 31 and 32 so that the projection 82 overlaps that different when the clipper is in the closed position of abutting the stationary blade 31 against the bottom of the recess 84, which contributes to successfully shearing the hairs once held between the comb 80 and the toothed edge of the stationary blade 31 without substantially missing the hairs, and therefore assuring an even cut. In this connection, the front portion of the bottom wall 71 is inclined such that the toothed edge of the movable blade 32 or stationary blade 31 is at an angle α of 70° to 90° in consideration of that the toothed edge of the movable blade 31 would certainly slip over the hairs when the angle is smaller than 70°.

As shown in FIGS. 10A and 11A, the hair clipper can be manipulated only by one hand of a user and the hair shearing can be effected by repeatedly pressing the housing 10 toward the base 70. For secure holding of the hair clipper, the base 70 is formed on the rear end portion with anti-slip ribs 73 as well as a finger stop 74 while the housing 10 is formed in its top surface with a depression 15 for engagement with the thumb of the hand gripping the clipper. It is noted at this time that the clipper has one switching mode which enables to reciprocate the movable cutter 32 only when the housing 10 is moved into the closed position and to stop operating the movable blade 32 in response to the housing 10 is moved out of the closed position, which will be discussed later.

The pivotal connection between the housing 10 and the base 70 is effected by a pivot axle 60 bridging between the rear ends of the base 70 and journaled in a bearing hole 16 formed in the rear end of the housing 10 between the upper and lower halves 11 and 12. Integrally projecting from the middle of the axle 60 is a lever 61 which extends over a flat bottom portion at the rear end of the lower half 12. A compression coil spring 62 is interposed between the end of the lever 61 and the upper bottom of the upper half 11, as shown in FIGS. 3 and 4, so as to bias the lever 61 in the counter-clockwise direction in the figures and in turn bias the base 70 in that direction about the axle 60 relative to the housing 10, whereby biasing the clipper into the open position of FIG. 3. As seen in the figures, the coil spring 62 is fitted around a post 17 which projects integrally from the inner bottom of the upper half 11 and is utilized to receive a screw 29 fastening the upper and lower halves 11 and 12.

The lever 61 is operatively connected at its free end to a slide member 90 with a stud 63 at the free end of the lever 61 engaged in a slit 91 of the slide member 90. The slide member 90 is held vertically movable within an upstanding frame 18 on the inner bottom surface of the lower half 12 and includes a contactor 92 which cooperates with the contact leads 52 and 53 to form an auxiliary power switch $SW_2$. That is, the contactor 92 straddles over the upright segments of the contact leads 52 and 53 held in position within the frame 18 to make and break the contact between the leads 52 and 53 in response to the vertical movement of the slide member 90 which is in turn responsive to the pivotal movement of the lever 61 or the base 70 relative to the housing 10. It is noted at this time that, as shown in the wiring diagram of FIG. 9, the above-mentioned main switch $SW_1$ comprises the contact leads 51, 52, and 53 and the contactor 44 which is movable together with the slider 40 among the three positions in constant contact only with the lead 51 connected to one electrode of the battery B. The other electrode of the battery B is connected by way of a lead element 54 to one end to the motor 20 of which other end is connected to the contact lead 53. The contact leads 52 and 53 have their respective ends arranged in spaced alignment with the end of the contact lead 51 such that the contactor 44 disconnects the leads 52 and 53 (the motor 20) from the lead 51 (the battery B) in the OFF position, straddles between the leads 51 and 52 in the dependent ON position, and straddles between the leads 51 and 53 to connect the motor 20 to the battery B in the independent ON position. In the dependent ON position of the main switch $SW_1$, the auxiliary switch $SW_2$ is operative to energize and deenergize the motor 20 in response to the movement of the base 70 between the open and closed positions. That is, when the base 70 is in the open position, the contactor 92 of the slide contact 90 is held by the lever 61 in an upper position of disconnecting the leads 52 and 53 from one another to deenergize the motor 20, but when the base 70 is moved into the closed position, the contactor 92 is brought by the correspondingly pivoting lever 61 into a lower position of conducting the leads 52 and 53 for energizing the motor 20, or reciprocating the movable blade 32. In this manner, the auxiliary switch $SW_2$ is rendered active to effect the switching in response to the movement of the clipper between the open and closed positions while the main switch $SW_1$ is in the dependent position. In this switching mode, therefore, the hair clipper can effect the shearing each time the housing 10 is pressed by the thumb of the user toward the base 70 into the closed position of FIG. 11A, and can stop driving the movable blade 32 each lime the housing 10 returns into the open position under the urging of the coil spring 62 as the user removes the pressing force on the housing 10. On the other hand, when the main switch $SW_1$ is in the independent ON position, the auxiliary switch $SW_2$ is bypassed to thereby energize the motor 26 irrespective of the positions of the hair clipper, or the pivotal movement of the housing 10 relative to the base 70.

Figure 8:
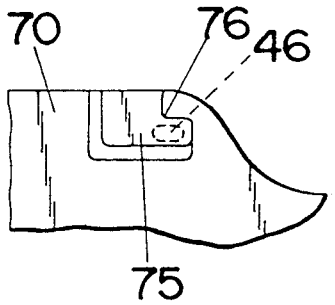
FIG. 8 is a partial view of a side wall of a base of the hair clipper.
Figure 9:
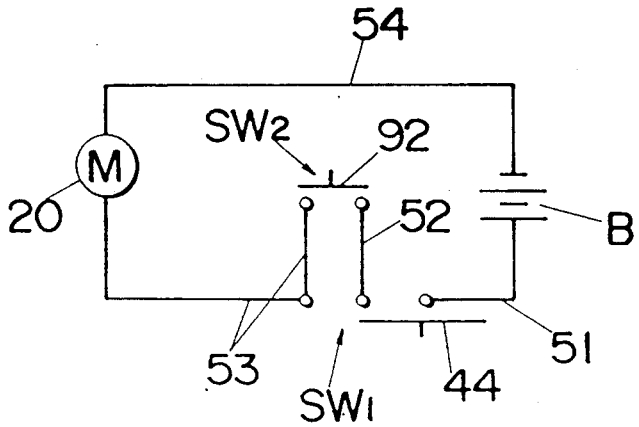
FIG. 9 is a wiring diagram of a power circuit of the hair clipper.
Figure 12:
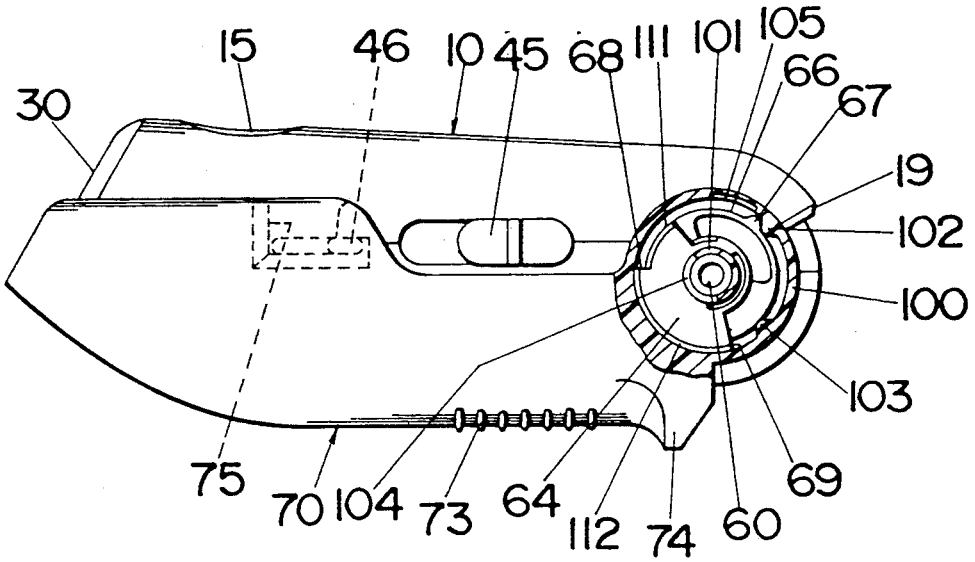
FIG. 12 is a side view, partially broken away, of the hair clipper in its close position.

At the OFF position of the main switch $SW_1$, the housing 10 can be locked into the closed position by engagement of latches 46 projected on the side faces of the housing 10 and grooves 75 formed respectively in the inner surface of the side walls 72 of the base 70, as shown in FIGS. 8 and 12. The latches 46 are formed on the side bars 41 and 42 of the slider 40 to be movable in the lengthwise direction of housing 10 together with the switch handle 45. As shown in FIG. 8, the groove 75 is of a generally L-shaped configuration with a vertical segment and a horizontal segment defining therebetween a shoulder 76 with which the latch 46 is to be engaged. A vertical section of the groove 75 is open to the upper edge of the side wall 72 so that the latch 46 at the dependent as well as independent positions of the main switch $SW_1$ can freely enter into the groove 75 through the vertical section without interfering with the shoulder 76 and that only the latch 46 at the OFF position can be engaged with the shoulder 76. The side walls 72 of the base 70 have enough resiliency such that they are capable of flexing outwardly to permit the latches 46 even at the OFF position of the main switch $SW_1$ to ride over shoulder 76 into engagement therebehind. The latch 46 at the independent or dependent ON position can be of course guided along the horizontal section into engagement with the shoulder 76 by sliding the switch handle 45 rearward while maintaining the housing 10 in the closed position. In brief, the housing 10 can be locked into the closed position irrespective of the positions of the switch handle 45.

The base 70 is provided with a partition 77 which is located immediately forwardly of the battery casing 25 in the closed position of the clipper so as to define a dust chamber 78 forwardly of the partition 77 for collecting the clipper hairs and preventing the collected hairs from scattering around the battery casing 25. The battery casing 25 is received in a space 79 defined rearwardly of the partition when the clipper is in the closed position.

Figure 14:
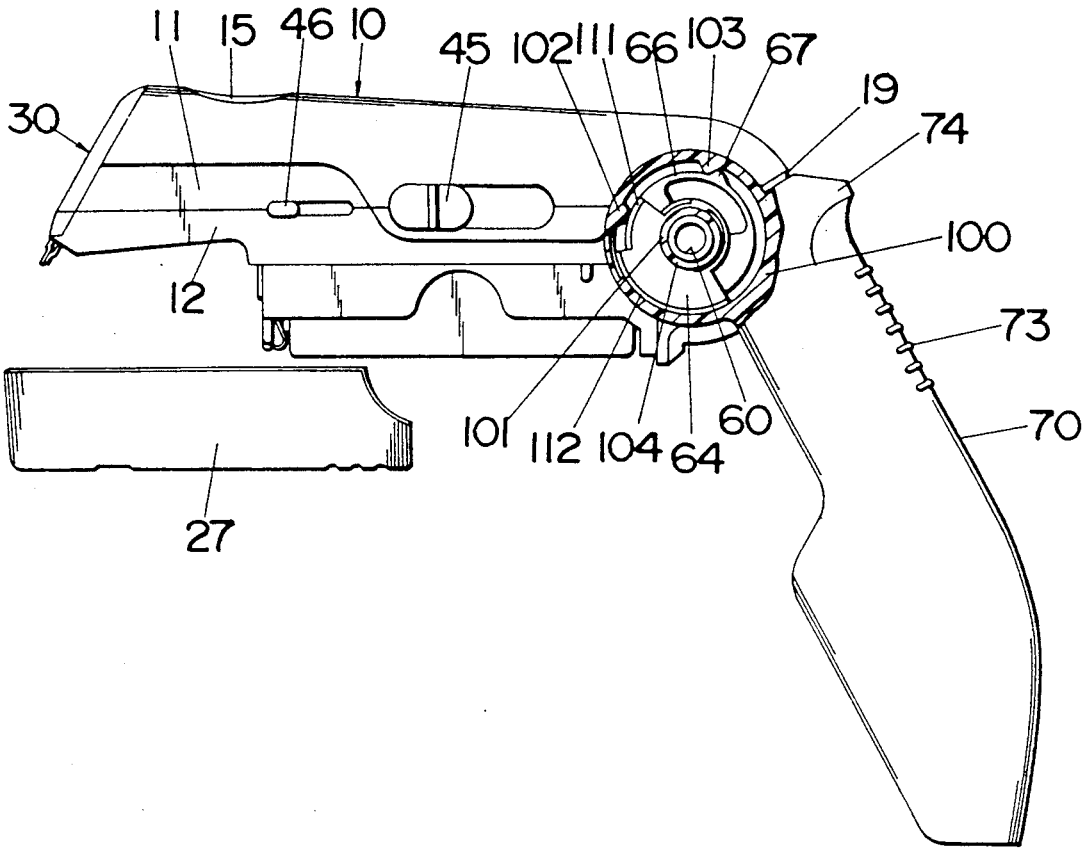
FIG. 14 is a side view, partially broken away, of the hair clipper in an extended position.
Figure 15:
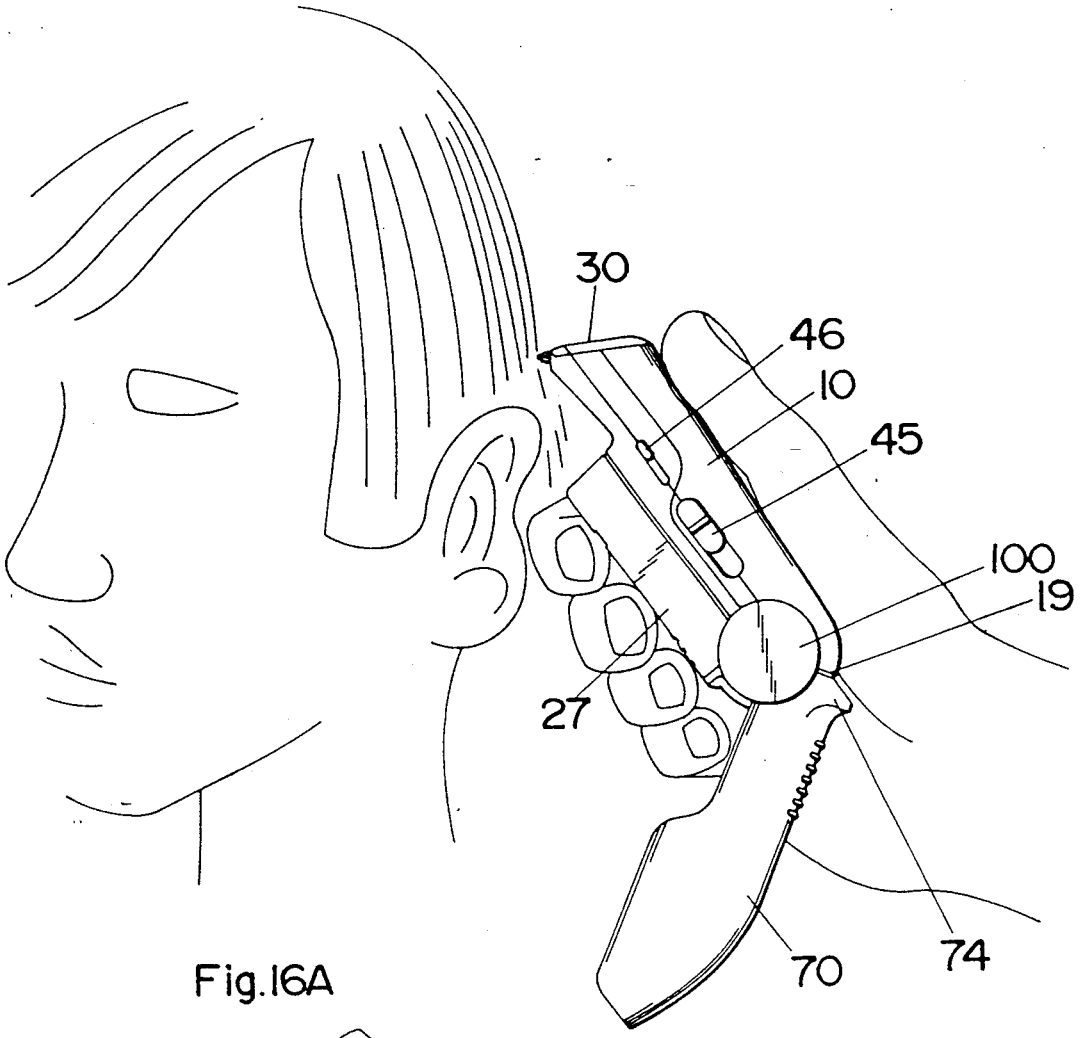
FIG. 15 is a view explaining the trimming operation of the hair clipper in its extended position.

Turning back to FIG. 6, the above pivot axle 60 is provided at its ends with rotor discs 64 which are supported within circular brackets 100 correspondingly formed at the rear end of the base 70 in such a manner that the axle 60 is also pivotable through a limited angular distance about an axis of the axle 60 with respect to the base 70, allowing the housing 10 to move past the open position further into an extended position of FIG. 14 in Which the housing 10 is kept at an angle of about 120° with respect to the base 70. In brief, the housing 10 pivots between the above open and closed position about the axis of the axle 60 with the axle 60 being kept rotatively fixed to the base 70, and the housing 10 pivots between the open and extended positions with an attendant pivotal movement of the axle 60 or the rotor discs 64 relative to the base 70. The extended position of FIG. 14 is provided for hair trimming alone by the cutting head without cooperation of the comb 80, as shown in FIG. 15. As seen in the figure, the trimming can be made by simply gripping the housing 10 by one hand of the user while the base 70 is kept widely opened so as not to hinder the trimming operation.

Figure 13:
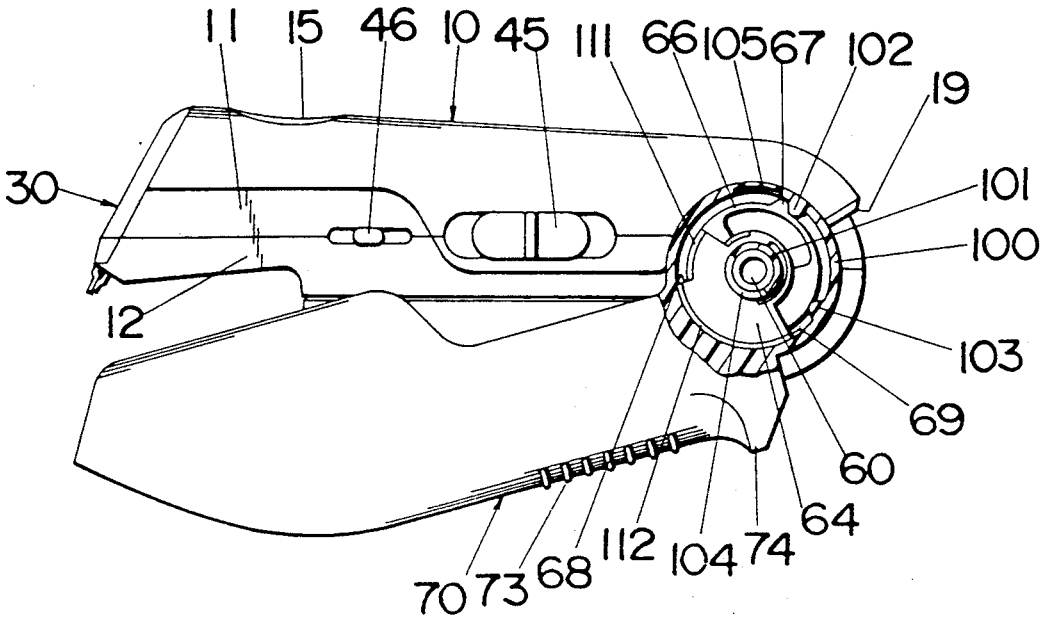
FIG. 13 is a side view, partially broken away, of the hair clipper in its open position.

The above limited pivotal movement of the axle 60 relative to the base 70 is made in a clicked manner such that the housing 10 can be clicked into the open position from which it is smoothly movable to the closed position and also clicked into the extended position. Further movement of the housing 10 past the extended position is prohibited by abutment between a rear stop 19 of the housing 10 and the finger stop 74 of the base 70. In detail, as seen in FIGS. 12, 13 and 14, each of the rotor discs 64 is provided in its center with a bearing hole 65 into which a ring projection 101 at the inner center of each bracket 100 extends for rotatively suppOrting the axle 60 between the brackets 100. Extending circumferentially around a portion of each disc 64 is a resilient bow 66 carrying a click projection 67. The click projection 67 is thus allowed to move resiliently radially so that it will ride over cams 102 and 103 circumferentially spaced along the periphery of the corresponding bracket 100 as the axle 60 pivots, thereby giving the above clicking movement. It is noted at this point that by engagement between the lever 61 and the housing 10, the axle 60 itself will pivot together with the housing 10 relative to the base 70 between the open position and the extended position, while the housing 10 will pivot about the axis of the axle 60 against and under the bias of the spring 62 between the open and closed positions. Also formed on the periphery of each disc 64 are spaced notches 68 and 69 which are brought into abutment with corresponding ribs (not shown) respectively formed on each bracket 100 when the housing 10 is moved from the open position to the closed position and when the housing 10 is moved to the extended position in order to prevent further undesired pivotal movement of the housing 10 relative to the base 70. In the present embodiment, a safe scheme is introduced to protect the pivot connection between the housing 10 and the base 70 from being damaged even when an excess force is applied to open the housing 10 and base 70 further beyond the extended positions. To this end, each disc 64 has its peripheral portions formed into tapered edges 111 and 112, and each bracket 100 has its center and peripheral portions partially formed into like tapered edges 104 and 105. When the housing 10 is forced to pivot further beyond the extended position, these tapered edges of the disc 64 and the bracket 100 cooperate with corresponding portions which may be the tapered edges of the bracket 100 and the disc 64 to easily escape the disc 64 away from the bracket 100 as resiliently flexing the brackets 100 outwardly, thereby disengaging the disc 64 from the bracket 100 and therefore allowing easy separation of the base 70 from the housing 10. The separated base 70 can be readily fixed into a correct position of engaging the ring 101 of each bracket 100 into the bearing hole 65 of each disc 64 simply by placing each disc 64 in alignment with the bracket 100 again as flexing the bracket 100 resiliently outwardly.

Figure 16A:
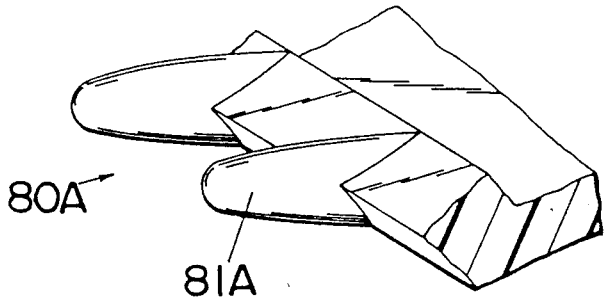
FIGS. 16A and 16B are partial views respectively illustrating modified configurations of the comb which may be utilized in the above embodiment.
Figure 16B:
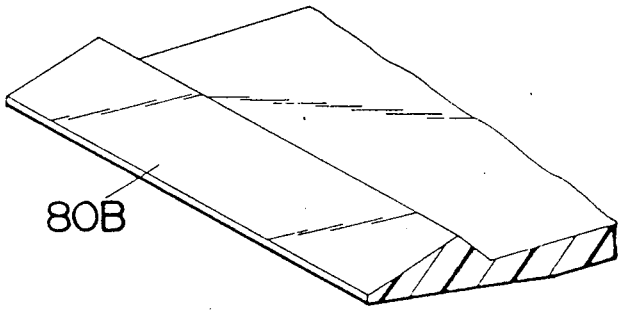

Although, in the above embodiment, the comb 80 is configured to have comb teeth 81 in the form of flat members, it is equally possible to provide comb 80A having comb teeth 81A which are bullet-shaped, as shown in FIG. 16A, or to provide comb 80B in the form of a wedge, as shown in FIG. 16B.

Figure 17:
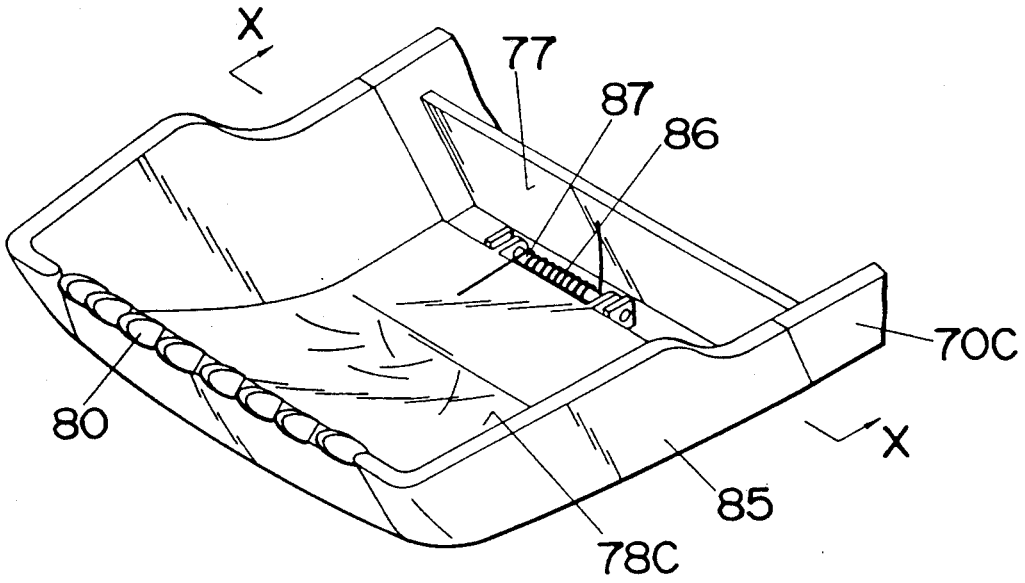
FIG. 17 is a perspective view illustrating a front portion of a base of a hair clipper in accordance with a modification of the above embodiment.
Figure 18:
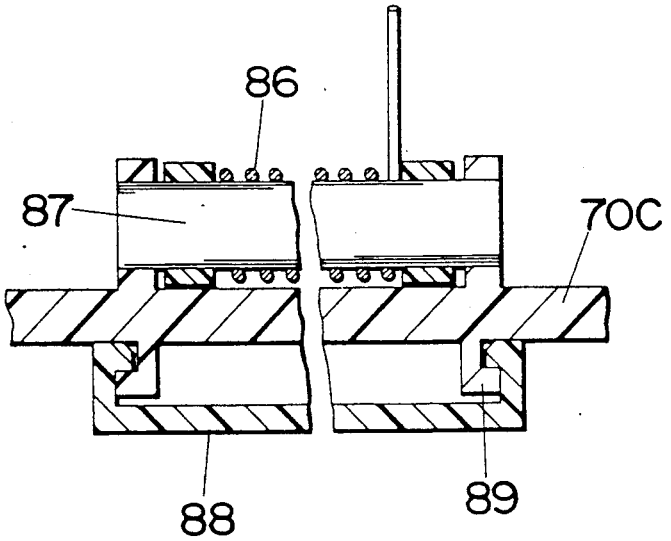
FIG. 18 is a sectional view corresponding line X—X of FIG. 17.
Figure 19A:
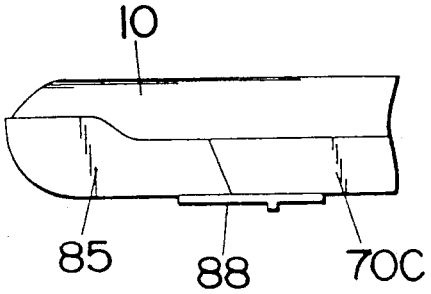
FIGS. 19A and 19B are schematic views respectively illustrating a front section of the base, in its closed and open positions, of the hair clipper of the above modification.
Figure 19B:
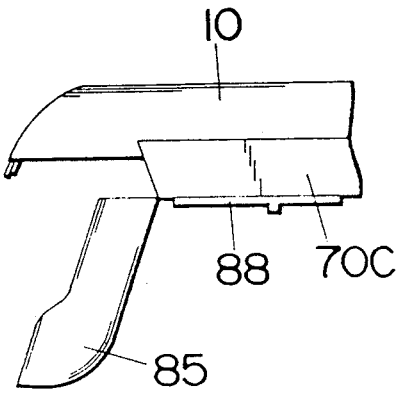
Figure 20:
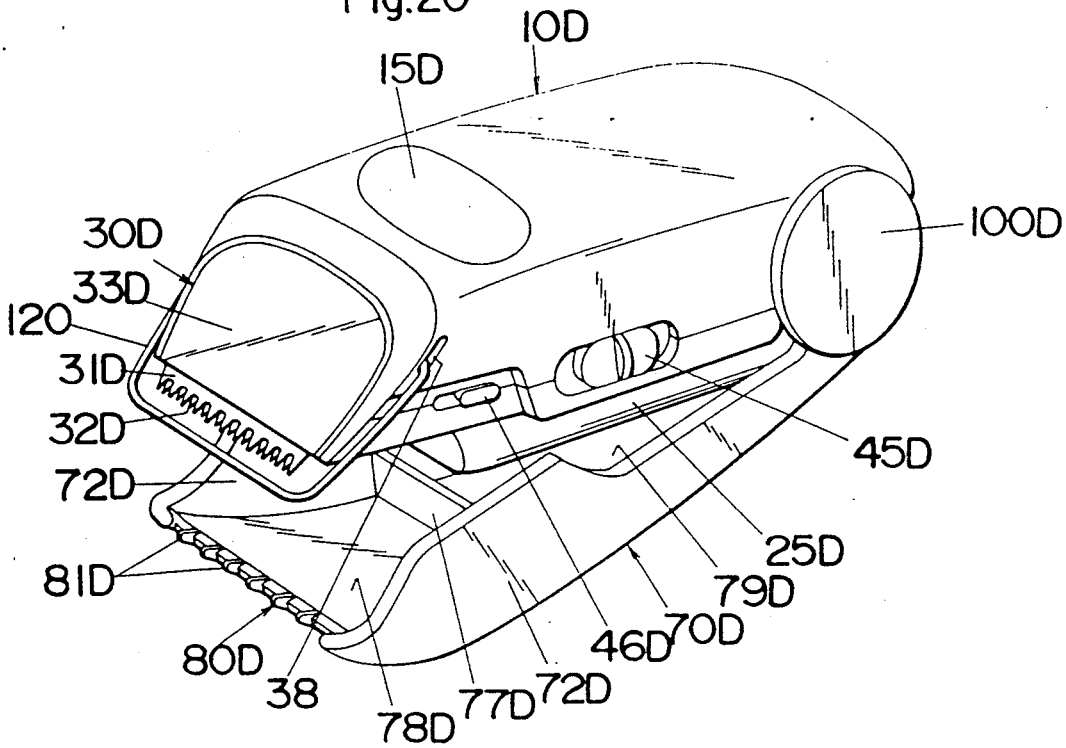
FIGS. 20 and 21 are perspective views illustrating a hair clipper respectively in its open and closed positions in accordance with another modification of the above embodiment.
Figure 21:
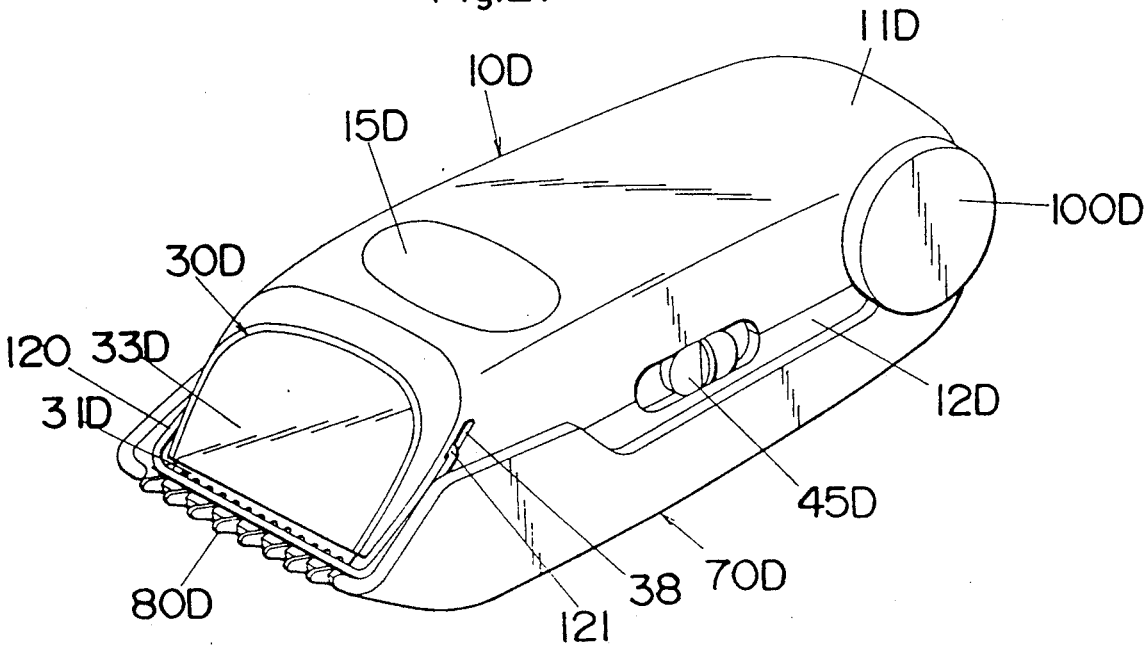

Further, as shown in FIGS. 17 to 19, a dust Chamber 78C may have a hinged bottom 85 for facilitating the disposal of the clipped hairs collected in the dust chamber 78C. The bottom 85 is biased into an open position of FIG. 19B by means of a torsion spring 86 wound around a hinge shaft 87 connecting the bottom 85 and the remaining portion 70C of a base. A slide lever 88 straddles over the outer surfaces of the bottom 85 and the portion 70C such that it keeps the hinged bottom 85 closed when the slide lever 88 is shifted forward into a position of FIG. 19A and it allows the hinged bottom 85 to open under the bias of the spring 86 when shifted rearwardly into a position of FIG. 19B. The slide lever 88 is retained on the bottom of the base by engagement with guide rails 89 formed integrally with the bottom 85 and the portion 70C.

Figure 22:
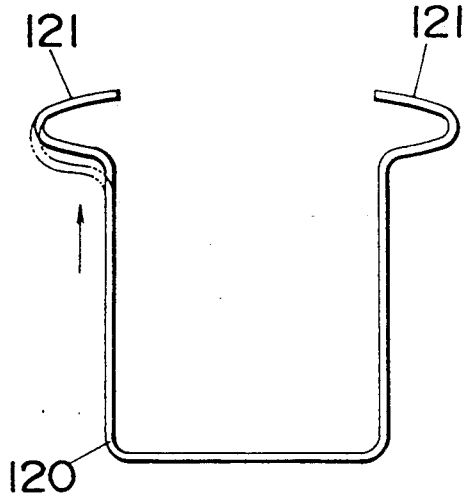
FIG. 22 is a plan view of a spring clamp utilized in the clipper of the above modification.
Figure 23:
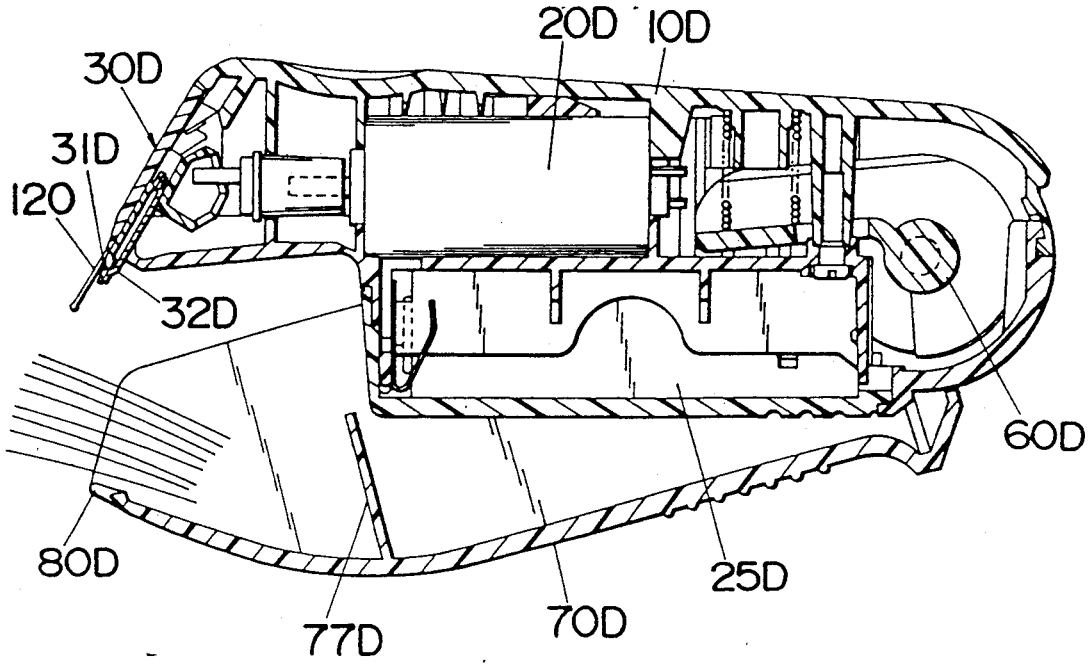
FIGS. 23 to 25 are sectional views of the hair clipper of the above modification, respectively in three different operating conditions.
Figure 24:
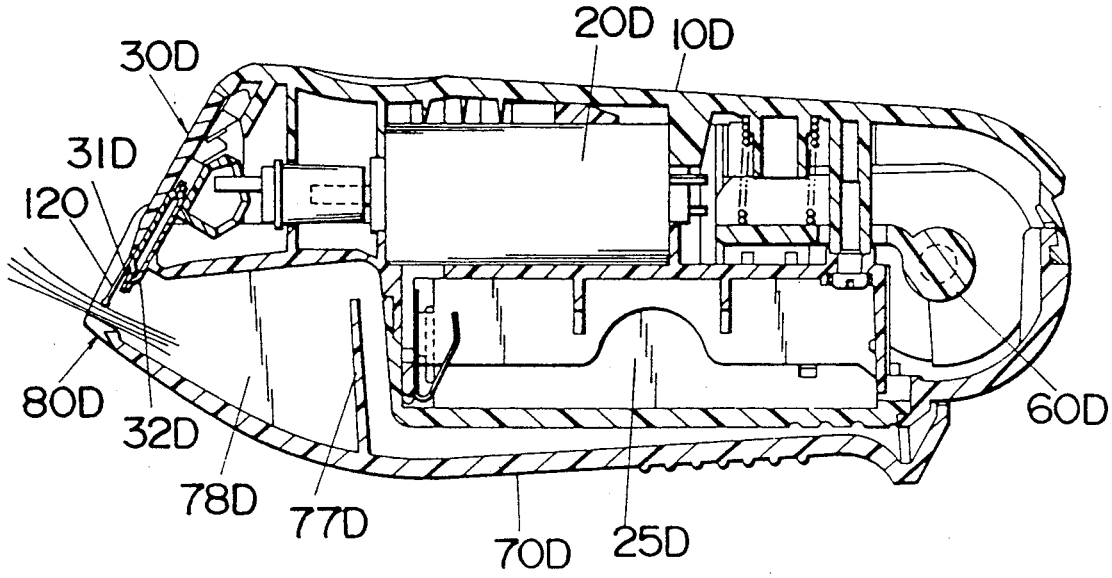
Figure 25:
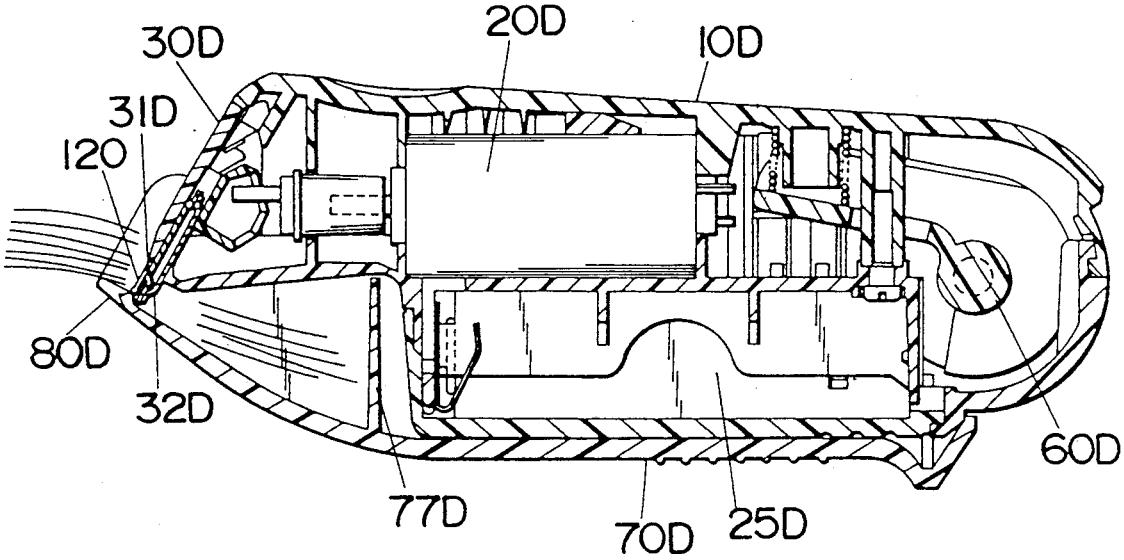

FIGS. 20 to 25 shows another modification of the above embodiment in which a spring clamp 120 is additionally included in a cutter head 30D. The other structures are identical to those in the above embodiment and therefore like parts are designated by like numbers with a suffix letter of "D". The spring clamp 120 is of a generally U-shaped configuration with a pair of vertical segments connected by a horizontal segment, as shown in FIG. 22. Each vertical segment has its upper end bent into a C-shaped hook 121 which engages into a corresponding slot 38 formed in either side of a housing 10D adjacent the cutter head 30D so that the spring clamp 120 extends in parallel with the cutting plane of the cutter head 30D forwardly thereof with the horizontal segment projecting further beyond the cutting edge of the cutter head 30D. As shown in FIGS. 23 to 25, when the clipper is manipulated to move from the open position to the closed position, the horizontal member of the spring clamp 120 comes firstly into contact with the hairs smoothed past a comb 80D before the cutting edge comes into contact with the hairs, as shown in FIG. 24, to thereby hold the hairs between the comb 80D and the spring clamp 120. Then, as the clipper is moved further into the closed position of FIG. 25, the spring clamp 120 is resiliently deformed at the C-shaped hooks 121, as indicated in FIG. 22, to retard to some extent the cutting edge to shear the hairs in the closed position, while firmly holding the hairs between the spring clamp 120 and the comb 80D forwardly of the cutting edge. With this result, the hairs being cut can be prevented from slipping away from the cutting edge and therefore can be cut easily and exactly as desired.

Figure 26A:
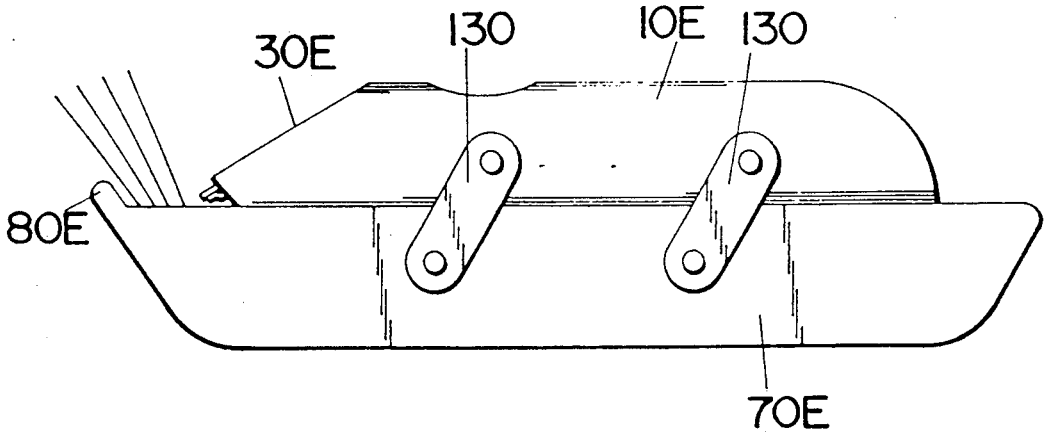
FIGS. 26A and 26B are side views, respectively shown in its open and closed positions, of a hair clipper in accordance with a second embodiment of the present invention.
Figure 26B:
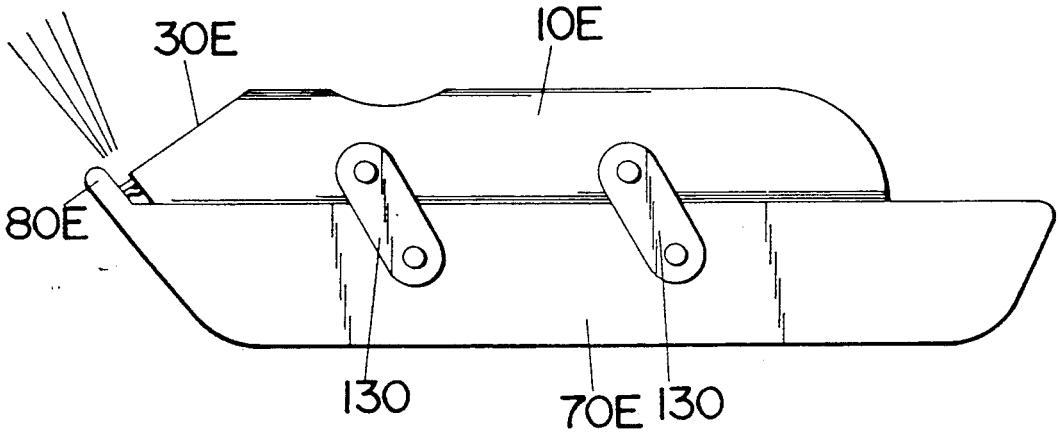
Figure 27A:
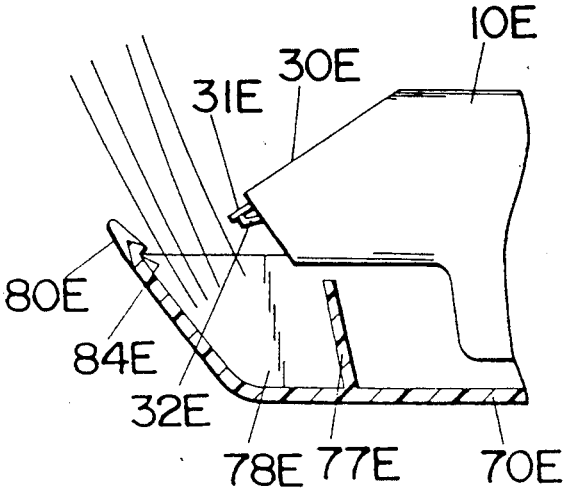
FIGS. 27A and 27B are partial views respectively illustrating the operations of the hair clipper corresponding to FIGS. 26A and 26B.
Figure 27B:
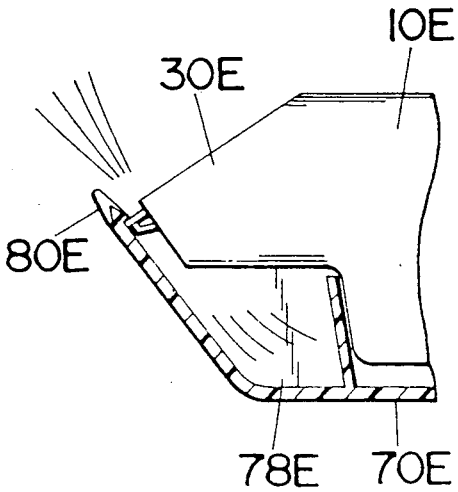

Second Embodiment <FIGS. 26 and 27>

A hair clipper in accordance with a second embodiment of the present invention comprises a housing 10E and a base 70E which are coupled together by means of arms 130 into parallel linkage so that the housing 10E is movable in parallel with the base 70E between an open position of FIG. 26A and a closed position of FIG. 26B. The housing 10E is identical in structure to that utilized in the above first embodiment to have a like cutting head 30E with a stationary blade 31E and a movable blade 32E. The base 70E is in the form of a top open box having at its forward edge a comb 80E of the like configuration as in the above embodiment. Also the base 70E is formed on its front exterior with a like inclined guide surface and in its front portion with a like dust chamber 78E defined forwardly of a partition 77E. The hair clipper of the second embodiment is manipulated likewise to repeat moving the housing 10E between the open position and the closed position for collecting the hairs between the comb and the cutting edge and shearing the hairs. Due to the parallel movement of the housing 10E relative to the base 70E, the cutting edge is kept substantially at a fixed height relative to the comb 80E and therefore a portion of the skin of a head in contact with the comb 80E during the cutting operation, enabling one to effect an easy and exact hair styling.

Figure 28A:
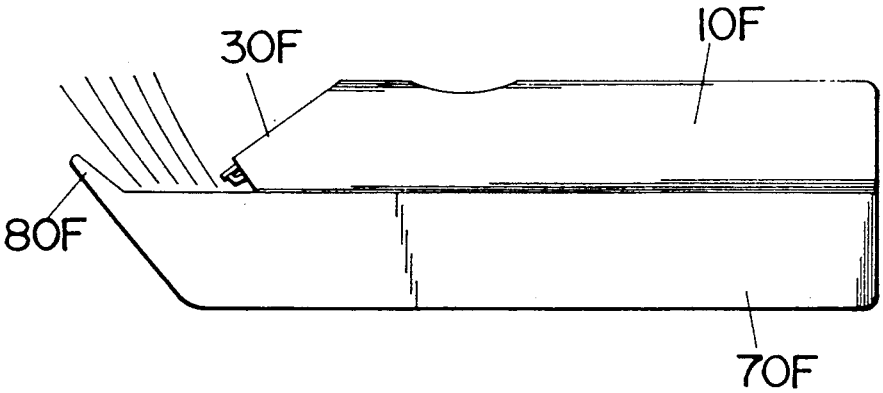
FIGS. 28A and 28B are side views, respectively shown in its open and closed positions, of a hair clipper in accordance with a third embodiment of the present invention.
Figure 28B:
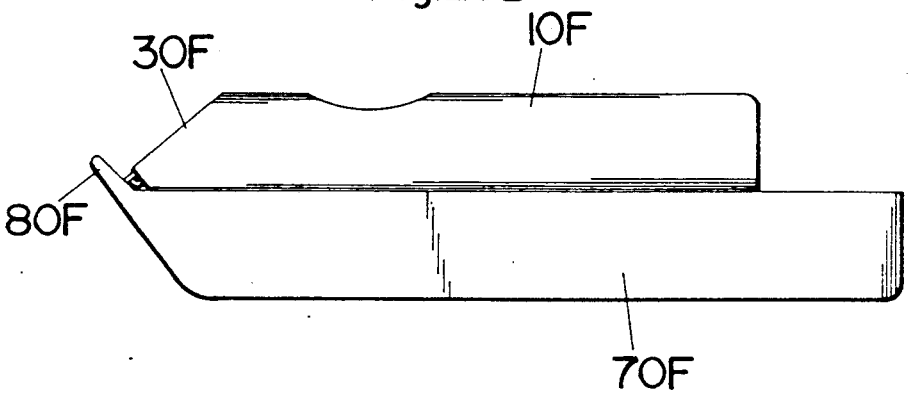
Figure 29:
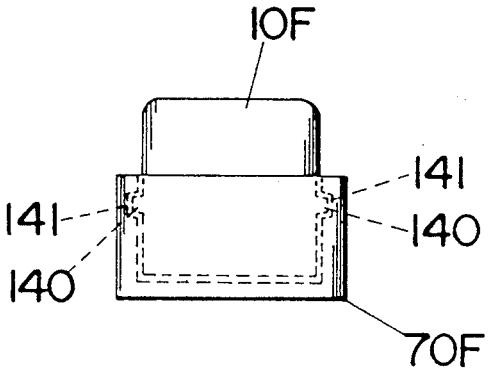
FIG. 29 is a schematic view of the hair clipper of the third embodiment.
Figure 30A:
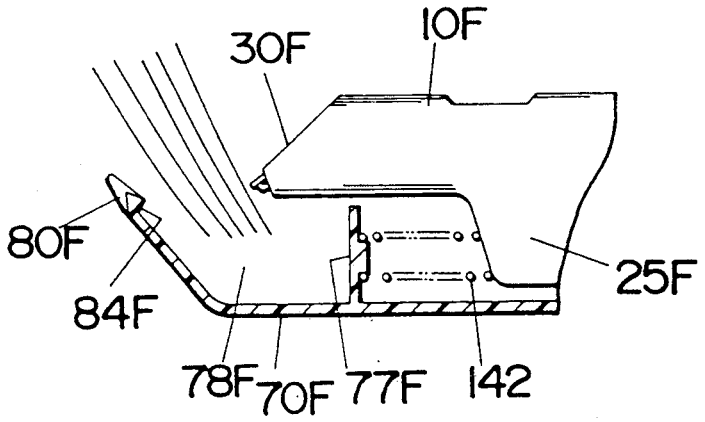
FIGS. 30A and 30B are partially sectional views, respectively shown in its open and closed positions, of the hair cutter of the third embodiment.
Figure 30B:
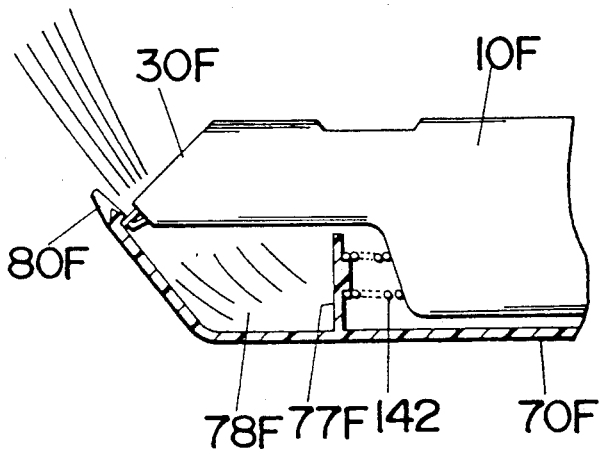

Third Embodiment <FIGS. 28 to 30>

A hair clipper according to a third embodiment is similar in structure to the above second embodiment except that a housing 10F has its bottom portion slidably received within a base 70F by engagement between bosses 140 on the opposite sides of the housing 10F and guide grooves 141 in the side walls of the base 70E. The other structures are identical to the first and second embodiment, therefore like parts are designated by like numerals with a suffix letter of "F". In the present embodiment, a compression spring 142 is interposed between a partition 77F and the front end of a battery casing 25F to bias the housing 10F toward the open position of FIG. 30A. With the hair clipper thus formed, the hair shearing is performed firstly by introducing the hairs between a comb 80F and the cutting edge in the open position of FIG. 30A and by moVing the housing 10F into the closed position of FIG. 30B against the bias of the spring 142.

Figure 31A:
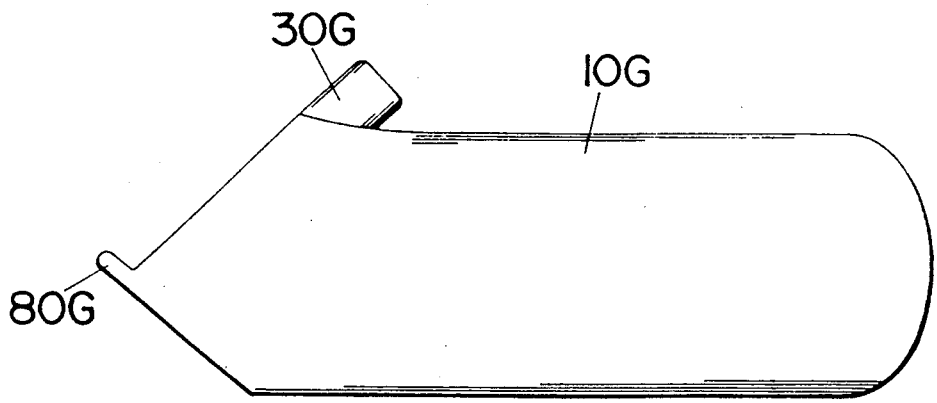
FIGS. 31A and 31B are side views, respectively shown in its open and closed positions, of a hair clipper in accordance with a fourth embodiment of the present invention.
Figure 31B:
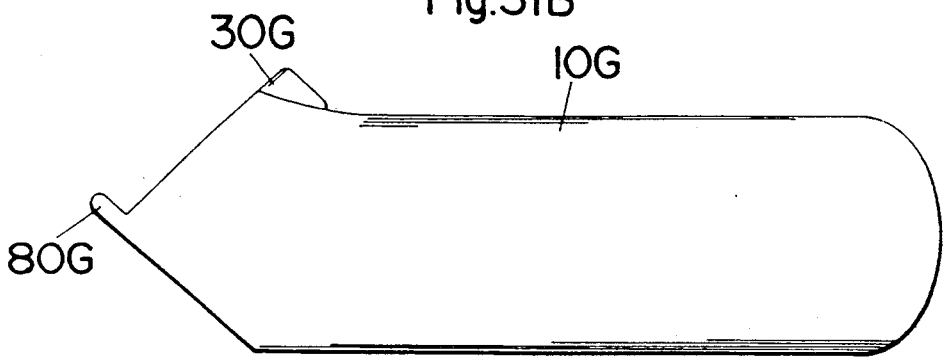
Figure 32A:
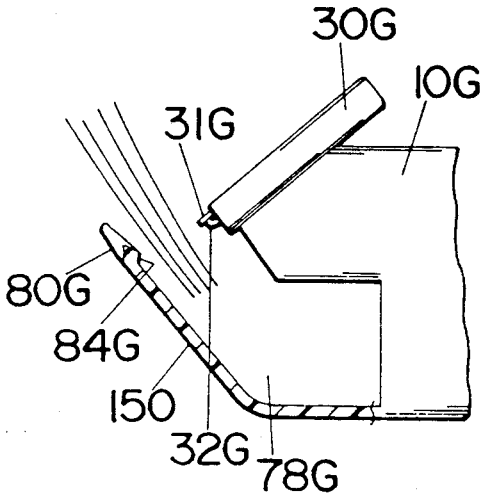
FIGS. 32A and 32B are partially sectional views, respectively shown in its open and closed positions, of the hair clipper of the fourth embodiment.
Figure 32B:
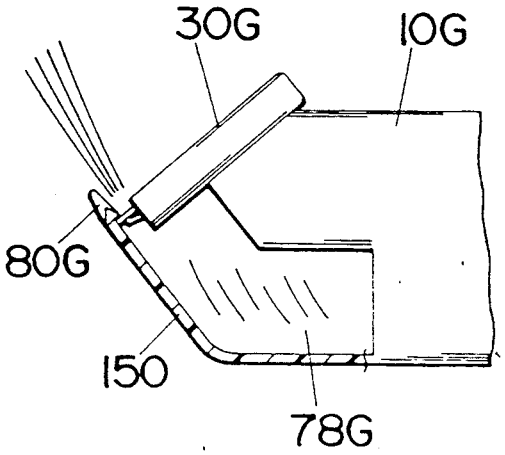

Fourth embodiment <FIGS. 31 and 32>

A hair clipper according to a fourth embodiment comprising a housing 10G with an integrally formed comb member 150 which projects from the forward bottom end of the housing 10G in an inclined relation with respect to a longitudinal axis of the housing 10G and is provided at its leading edge with a like comb 80G. The housing 10G is provided at its front end with a like cutting head 30G composed of a stationarY blade 31G and a movable blade 32G defining therebetween a cutting plane which cross with the comb member 150 at an angle of 70° to 90°. The cutting head 30G is slidably supported on the front end of the housing 10G to be movable between an open position of FIG. 32A and a closed position of FIG. 32B along the cutting plane. The upper end of the cutter head 30G project above the top surface of the housing 10G to be pressed by the thumb of a user's hand gripping the housing 10G and is preferably biased into the open position such that the hair shearing can be effected simply by pressing the cutter head 30G against the spring bias into the closed position after smoothing the hairs past the comb 80G between the comb 80G and the cutting edge of the cutter head 30G with the cutter head 30G left in the open position. The clipped hairs are collected into a like dust chamber 78G formed between the comb member 150 and the front end of the housing 10G. The comb 80G in the present embodiment is of the same configuration as that of the first embodiment to include a recess 84G for receiving the cutting edge of the cutter head 30G in the closed position.

What is claimed is:

1. A hair clipper comprising:

a cutter head comprising a stationary blade with a toothed edge and a movable blade with a toothed edge, said movable blade being driven to reciprocate relative to said stationary blade in hair shearing engagement between the toothed edges of said stationary and movable blades, said toothed edge of the stationary blade defining a cutting edge; and a hair entrapping member movable relative to said cutting head between an open position where it is spaced from said cutting edge of said cutter head and a closed position where it is held in close proximity to said cutting edge, said hair entrapping member allowing hairs to extend past said cutting edge in said open position and seizing said hairs between said cutting edge and said hair entrapping member in said closed position for shearing said hairs by cooperation of said movable and stationary blades said cutter head being formed at a forward end of an elongated housing and said hair entrapping member being formed at a forward end of an elongated base, said housing being pivotally connected to said base at the respective rearward ends so that said hair entrapping member is capable of moving between said open and closed positions as said base pivots relative to said housing; said base being of a generally U-shaped configuration having a bottom wall and a pair of opposed side walls extending from the lateral sides of said bottom wall to define therebetween an area for receiving a bottom portion of said housing, said housing includes a battery case which projects on the rear bottom thereof and accommodates therein a battery for energizing an electric motor to drive said movable cutter to reciprocate, said area being divided by a transverse partition into longitudinally spaced front and rear portions, said front portion having said bottom wall terminating at said hair entrapping member and defining therein a dust chamber for receiving clipped hairs, and said rear portion defining a chamber for receiving said battery case projecting on the rear bottom of said housing.

2. A hair clipper as set forth in claim 1, wherein said hair entrapping member has a hair guide edge extending in parallel with said cutting edge of said hair cutter and has a portion projecting toward said cutting edge, and wherein said movable blade has its toothed edged retarded from the corresponding toothed edge of said stationary blade by a limited distance, said projecting portion defining therebehind a recess into which said cutting edge extends when said hair entrapping member is in said closed position such that said projecting portion overlaps the toothed edge of said stationary blade forwardly thereof by an extent that at least said limited distance is included in said overlapped portion.

3. A hair clipper as set forth in claim 2, wherein said hair entrapping member is in the form of a comb having a number of comb teeth arranged in parallel with the cutting edge of said cutter head, said comb teeth defining said hair guide edge at its leading edge and defining said projecting portion at its trailing edge.

4. A hair clipper as set forth in claim 1, wherein said housing includes a drive source operatively connected to said movable blade in order to drive it in said reciprocating manner, said housing including a switch handle movable between an ON position of energizing said drive source and an OFF position of deenergizing said drive source, said housing further including lock means which is associated with said switch handle in such a manner as to prevent the pivotal movement of said base relative to said housing for locking said hair entrapping member into said closed position when said switch handle is in said OFF position.

5. A hair clipper as set forth in claim 1, wherein said hair entrapping member is in the form of a comb of which teeth are arranged in a parallel relation to the cutting edge of said cutter head.

6. A hair clipper comprising:

an elongated housing provided at its forward end with a cutter head, said cutter head comprising a stationary blade with a toothed edge and a movable blade with a toothed edge, the toothed edge of said stationary blade defining a cutting edge of said cutter head;

drive means included in said housing and operatively connected to said movable blade for reciprocating said movable blade relative to said stationary blade in hair shearing engagement between the toothed edges of said stationary and movable blades;

an elongated base provided at its forward end with a comb which has a number of comb teeth arranged in parallel relation to said toothed edge of said stationary blade;

said elongated base pivotally connected to said housing at their rear ends such that said comb is brought into an open position where it is spaced from said cutting edge of said cutter head when said base pivots about a pivot axis relative to said housing in one direction and is brought into a closed position where it is held in a close relation with said cutting edge when said base pivots in the opposite direction, said comb in said open position allowing hairs to extend past said cutting edge and said comb in said closed position allowing said hairs to be seized between said comb and said cutting edge for shearing said hairs by cooperation of said movable and stationary blades;

a power switch included in said housing and being associated with said pivotal movement of said base relative to the housing such that it energizes said drive source in response to said comb being brought into said closed position and deenergizes the same in response to said comb brought into said open position.

7. A hair clipper as set forth in claim 6, wherein said base is spring biased to pivot relative to said housing in a direction of urging said comb into said open position.

8. A hair clipper as set forth in claim 6, wherein said power switch has a switch handle slidable between an OFF position of deenergizing said drive source and an ON position of energizing said drive source, said switch handle being coupled to a latch member which is shiftable into a lock position and a release position, respectively when said switch handle moves into said OFF position and into said ON position, and said latch member engageable with said base to lock the same into said closed position when moved into said lock position, and disengageable from said base when moved into said release position to thereby permit said base to return into said open position by said spring bias.

9. A hair clipper as set forth in claim 6, wherein said base is pivotable about said pivot axis in such a manner as to have said comb further movable away from said cutting edge past said open position into an extended position in which said power switch is capable of energizing the drive source for driving the movable blade.

10. A hair clipper as set forth in claim 9, wherein said base is clicked into said extended position.

11. A hair clipper comprising:

an elongated housing provided at its forward end with a cutter head, said cutter head comprising a stationary blade with a toothed edge and a movable blade with a toothed edge, the toothed edge of said stationary blade defining a cutting edge of said cutter head;

drive means included in said housing and operatively connected to said movable blade for reciprocating said movable blade relative to said stationary blade in hair shearing engagement between the toothed edges of said stationary and movable blades;

an elongated base provided at its forward end with a comb which has a number of comb teeth arranged in parallel relation to said toothed edge of said stationary blade;

said elongated base pivotally connected to said housing at their rear ends such that said comb is brought into an open position where it is spaced from said cutting edge of said cutter head when said base pivots about a pivot axis relative to said housing in one direction and is brought into a closed position where it is held in a close relation with said cutting edge when said base pivots in the opposite direction, said comb in said open position allowing hairs to extend past said cutting edge;

a power switch included in said housing for energizing and deenergizing said drive means.

12. A hair clipper as set forth in claim 11 in which said power switch is associated with the movement of said elongated base between said open and closed positions in such a manner as to energize said drive means for reciprocation of said movable blade when said elongated base is brought into said closed position and to deenergize said drive source when said elongated base is brought into said open position.

13. A hair clipper comprising:

an elongate housing having at one end a cutter head comprising a stationary blade with a toothed edge and a movable blade with a toothed edge, said movable blade being driven to reciprocate relative to said stationary blade in hair shearing engagement between the toothed edges of said stationary and movable blades, said toothed edge of the stationary cutter defining a cutting edge; and a hair entrapping member coupled to said housing and movable relative to said cutting head between an open position where it is spaced from said cutting edge of said cutter head and a closed position where it is held in close proximity to said cutting edge, said hair entrapping member allowing hairs to extend past said cutting edge in said open position and seizing said hairs between said cutting edge and said hair entrapping member in said closed position for shearing said hairs by cooperation of said movable and stationary blades, said hair entrapping member being formed at its front end with a continuous straight edge extending parallel to the cutting edge of the cutter head, said continuous straight edge acting to hold the hairs in position for shearing when said hair entrapping member is in the closed position.

14. A hair clipper as set forth in claim 13 wherein said hair entrapping member is formed at its forward end with a projection extending parallel to said cutting edge, said projection having formed therebehind a recess, said continuous straight edge being defined at an intersection between said projection and said recess.

15. A hair clipper as set forth in claim 14 wherein said front end of said hair entrapping member is in the form of a comb having a plurality of teeth formed to project forwardly from said projection.

* * * * *